US008302423B2

(12) United States Patent
Lee et al.

(10) Patent No.: US 8,302,423 B2
(45) Date of Patent: Nov. 6, 2012

(54) ICE-MAKING DEVICE FOR REFRIGERATOR AND REFRIGERATOR HAVING THE SAME

(75) Inventors: Moon-Seok Lee, Gimhae (KR); O-Bong Choi, Changwon (KR); Sang-Bae Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 1127 days.

(21) Appl. No.: 12/162,582

(22) PCT Filed: Dec. 19, 2006

(86) PCT No.: PCT/KR2006/005541

§ 371 (c)(1),
(2), (4) Date: Jul. 29, 2008

(87) PCT Pub. No.: WO2007/094554

PCT Pub. Date: Aug. 23, 2007

(65) Prior Publication Data

US 2009/0038330 A1 Feb. 12, 2009

(30) Foreign Application Priority Data

Feb. 17, 2006 (KR) ..... 10-2006-0015764
Feb. 17, 2006 (KR) ..... 10-2006-0015766
Feb. 17, 2006 (KR) ..... 10-2006-0015783
Feb. 17, 2006 (KR) ..... 10-2006-0015784

(51) Int. Cl.
*F25C 1/22* (2006.01)
*F25C 23/12* (2006.01)
*F25C 1/00* (2006.01)
*F25D 25/00* (2006.01)

(52) U.S. Cl. ..... 62/340; 62/337; 62/347; 62/377

(58) Field of Classification Search ..... 62/377, 62/345, 347, 337–338, 340
See application file for complete search history.

(56) References Cited

U.S. PATENT DOCUMENTS 3,744,270 A * 7/1973 Wilcox ..... 62/344
6,050,097 A 4/2000 Nelson et al.
6,148,624 A 11/2000 Bishop et al.
6,851,272 B2 * 2/2005 Yu ..... 62/310

FOREIGN PATENT DOCUMENTS

JP 4-257677 * 9/1992

(Continued)

*Primary Examiner* — Frantz Jules
*Assistant Examiner* — Cassey D Bauer
(74) *Attorney, Agent, or Firm* — Birch, Stewart, Kolasch & Birch, LLP

(57) ABSTRACT

The present invention relates to an ice-making device for a refrigerator and a refrigerator having the same. The ice-making device of the present invention comprises a water tank detachably mounted to a rear surface of a refrigerator door; an ice-making housing detachably mounted to the rear surface of the door below the water tank and provided with a predetermined installation space therein; an ice tray mounted into the installation space and formed with a plurality of ice-making grooves in which water supplied from the water tank is frozen into ice; a valve assembly operating to selectively supply water stored in the water tank to the ice tray when the water tank is installed or withdrawn; and an ice bank for storing ice made in the ice tray, wherein the ice bank is installed in the installation space to be received in or withdrawn out of the installation space. According to the present invention, there are advantages in that ice can be more simply and easily taken out, can be made and stored in a more sanitary way and can be made more rapidly, and power consumption can be minimized while the ice is taken out.

30 Claims, 16 Drawing Sheets

FOREIGN PATENT DOCUMENTS

| | | | | |
|---|---|---|---|---|
| KR | 20-007058 | U | | 2/1999 |
| KR | 20-0186556 | Y1 | | 7/2000 |
| KR | 10-0309239 | B1 | | 1/2002 |
| KR | 10-0539562 | B1 | | 12/2005 |
| WO | WO 2005/026631 | | * | 3/2005 |

* cited by examiner

ICE-MAKING DEVICE FOR REFRIGERATOR AND REFRIGERATOR HAVING THE SAME

TECHNICAL FIELD

The present invention relates to a refrigerator, and more particularly, to an ice-making device for a refrigerator and a refrigerator including the ice-making device.

BACKGROUND ART

Refrigerators are household appliances for keeping foods refrigerated or frozen to store the foods in a fresh state for a long time. The interior of the refrigerator is partitioned into freezing and refrigerating chambers, and an ice-making device is provided in the freezing chamber.

FIGS. 1 and 2 show a refrigerator provided with a related art ice-making device, and FIG. 3 shows the ice-making device installed in the refrigerator shown in FIG. 2.

As shown in these figures, freezing and refrigerating chambers 11 and 13 which are partitioned side by side are provided within a main body 10 of a refrigerator. The main body 10 is provided with a freezing chamber door 11*a* and a refrigerating chamber door 13*a* in order to selectively open or close the freezing and refrigerating chambers 11 and 13, respectively. The freezing and refrigerating chamber doors 11*a* and 13*a* are hinged to opposite lateral sides of the main body 10, respectively, such that the doors can be pivoted in a forward direction.

Furthermore, home bars 15 and 17 are provided on the freezing and refrigerating chamber doors 11*a* and 13*a*, respectively. Foods such as drinking water are stored in each of the home bars 15 and 17. Each of the home bars 15 and 17 is composed of a home bar housing 15*a* or 17*a* and a home bar door 15*b* or 17*b*.

The home bar housings 15*a* and 17*a* are provided on rear surfaces of the freezing and refrigerating chamber doors 11*a* and 13*a*, respectively. The home bar housings 15*a* and 17*a* are provided with predetermined storage spaces, respectively, in which foods such as drinking water can be received.

Each of the home bar doors 15*b* and 17*b* serves to selectively open or close an opening that is formed by cutting out a portion of the freezing or refrigerating chamber door 11*a* or 13*a* to correspond to the home bar housing 15*a* or 17*a*. Each of the home bar doors 15*b* and 17*b* is installed to be vertically pivoted.

Referring to FIG. 2, an ice-making device 19 is installed at one side of the freezing chamber 11. The ice-making device 19 is used to make ice. The ice-making device 19 is retractably installed within the freezing chamber 11. Further, as shown in FIG. 3, the ice-making device 19 is composed of a support frame 21 and a pair of ice trays 23.

The support frame 21 is formed into a rectangular shape. The support frame 21 functions to rotatably support the ice trays 23. That is, the ice trays 23 can be installed to be rotatable within the support frame 21.

Each of the ice trays 23 is formed with a plurality of ice-making grooves 23*a*. Support shafts 24 are provided at the centers of front and rear surfaces of the ice trays 23, respectively. The ice tray 23 is rotated clockwise or counterclockwise about the support shaft 24 as viewed in FIG. 2. To this end, the support shaft 24 is rotatably inserted into the rear surface of the support frame 21.

A stopper 25 is installed at a certain position on the rear surface of the support frame 21 corresponding to the left side of the support shaft 24 as viewed in this figure. The stopper 25 protrudes from the rear surface of the support frame 21 by a predetermined distance and is positioned on a moving path of the ice tray 23. The ice tray 23 rotating about the support shaft 24 is twisted by the stopper 25.

A handle 26 is provided on a front surface of the support frame 21 corresponding to the front side of the ice tray 23. The handle 26 is a portion which a user grips to rotate the ice tray 23. A pair of handles 26 are provided to be in harmony with the number of ice trays 23.

Referring again to FIG. 2, an ice bank 27 is installed below the ice-making device 19 within the freezing chamber 11. Ice made in the ice-making device 19 is stored in the ice bank 27. The ice bank 27 is also retractably installed within the freezing chamber 11.

The ice-making device configured as such is operated as follows.

First, the ice-making grooves 23*a* of the ice tray 23 are filled with water. The freezing chamber door 11*a* is opened to open the freezing chamber 11. Next, the ice-making device 19 is received at one side of the freezing chamber 11. After the ice-making device 19 is installed in such a way, the freezing chamber door 11*a* is closed to close the freezing chamber 11.

In the meantime, if the water filled in the ice-making grooves 23*a* is frozen after a certain period of time, the freezing chamber door 11*a* is again opened to open the freezing chamber 11. If the handle 26 is rotated clockwise as viewed in FIG. 2, the ice tray 23 is also rotated in the same direction.

When the ice tray 23 is rotated by a predetermined angle, a rear end of the ice tray 23 is caught to the stopper 25. Thus, the ice tray 23 cannot be further rotated clockwise as viewed in FIG. 2. If the handle 26 is further rotated clockwise from such a state as viewed in FIG. 2, the ice tray 23 is twisted. Therefore, ice made in the ice-making grooves 23*a* is separated from the ice tray 23 and then stored in the ice bank 27.

However, the related art ice-making device for a refrigerator has the following problems.

If a user wishes to withdraw the ice bank 27 with ice stored therein from the freezing chamber 11, he/she should pull the freezing chamber door 11*a* to open the freezing chamber 11. Therefore, there is a problem in that it is troublesome to put the ice bank 27 into or out of the freezing chamber.

Moreover, when the freezing chamber 11 is opened in order to withdraw the ice bank 27 from the freezing chamber, cold air in the freezing chamber 11 is discharged to the outside. That is, in the related art ice-making device for a refrigerator, cold air in the freezing chamber 11 is unnecessarily discharged to the outside while the ice bank 27 is withdrawn. Therefore, power consumption of the refrigerator is increased.

Further, the ice bank 27 is accommodated in the freezing chamber 11. Thus, it is likely that ice stored in the ice bank 27 is impregnated with odor of foods stored in the freezing chamber 11.

Furthermore, in the related art ice-making device for a refrigerator, water filled in the ice-making grooves 23*a* of the ice tray 23 is frozen into ice due to cold air circulating in the freezing chamber 11, after a predetermined period of time. Therefore, there is a problem in that water filled in the ice-making grooves 23*a* of the ice tray 23 may be splashed out of the grooves due to impact generated when the freezing chamber door 11*a* is opened or closed.

DISCLOSURE

Technical Problem

Accordingly, the present invention is conceived to solve the problems in the prior art. An object of the present invention is to provide an ice-making device for a refrigerator capable of withdrawing ice in a simpler way, and a refrigerator having the same.

Another object of the present invention is to provide an ice-making device for a refrigerator capable of minimizing power consumption when ice is taken out, and a refrigerator having the same.

A further object of the present invention is to provide an ice-making device for a refrigerator capable of minimizing contamination in the refrigerator in the process of making ice, and a refrigerator having the same.

A still further object of the present invention is to provide an ice-making device for a refrigerator capable of preventing ice stored in an ice bank from being impregnated with odor of other foods, and a refrigerator having the same.

A still further object of the present invention is to provide an ice-making device for a refrigerator capable of rapidly making ice, and a refrigerator having the same.

Technical Solution

According to an aspect of the present invention for achieving the objects, there is provided an ice-making device for a refrigerator comprising an ice-making device for a refrigerator, comprising: a water tank detachably mounted to a rear surface of a refrigerator door; an ice-making housing detachably mounted to the rear surface of the door below the water tank and provided with a predetermined installation space therein; an ice tray mounted into the installation space and formed with a plurality of ice-making grooves in which water supplied from the water tank is frozen into ice; a valve assembly operating to selectively supply water stored in the water tank to the ice tray when the water tank is installed or withdrawn; and an ice bank for storing ice made in the ice tray, wherein the ice bank is installed in the installation space to be received in or withdrawn out of the installation space.

In one embodiment of the invention, the valve assembly includes: an actuating protrusion provided at a position on the rear surface of the door; a valve lever actuated by the actuating protrusion and installed to be movable through a discharge port formed in a bottom surface of the water tank to supply the water stored in the water tank to the ice tray; a valve cover provided at a tip end of the valve lever positioned in the water tank through the discharge port to selectively open or close the discharge port by movement of the valve lever; and an elastic member for imparting an elastic force to the valve lever in a direction in which the valve cover is moved to close the discharge port.

In another embodiment of the invention, the water tank is detachably installed in a mounting space defined between a bottom surface of one of door baskets provided on the rear surface of the door and a top surface of the ice-making housing; and the actuating protrusion is formed to extend a predetermined length on the bottom surface of the door basket or the top surface of the ice-making housing corresponding to the ceiling or bottom of the mounting space in a direction in which the water tank is received in or withdrawn out of the mounting space.

In another embodiment of the invention, the valve lever includes a lever main body installed below the water tank to allow a tip end thereof to be pivotally moved vertically with respect to a pivot end thereof by a predetermined angle, and a lever protrusion extending upward from the tip end of the lever main body to penetrate through the discharge port; the valve cover is integrally formed with a tip end of the lever protrusion; and the valve lever is vertically pivoted within a range from a position where the valve cover is brought into close contact with a floor surface of the water tank adjacent to the discharge port to close the discharge port to a position where the valve cover is spaced apart from the floor surface of the water tank to open the discharge port.

In another embodiment of the invention, the elastic member is a torsion spring for imparting an elastic force to allow the valve lever to be pivoted downward.

In another embodiment of the invention, the water tank includes: a tank main body formed into a polyhedral shape with an open top to define a water storage space therein and provided with a discharge port at a bottom surface thereof; a tank cover coupled to the open top of the tank main body to selectively open or close the water storage space and provided with a supply port at a predetermined position thereof to allow water to be supplied and stored in the water storage space; and a supply port cover pivotally installed to the tank cover to selectively open or close the supply port, and the water tank is formed of a transparent or translucent material to visually check an amount of water stored in the water storage space from the outside.

In another embodiment of the invention, the water tank is prevented from being inadvertently detached, by a fixing means, in a state where the water tank is mounted to the rear surface of the door.

In another embodiment of the invention, the fixing means includes: a fastening hook provided on any one of the rear surface of the door and a rear surface of the water tank; and a fastening protrusion provided on the other of the rear surface of the door or the rear surface of the water tank to be selectively and elastically fastened to the fastening hook.

In another embodiment of the invention, the water tank is detachably installed in a mounting space defined between a bottom surface of one of door baskets provided on the rear surface of the door and a top surface of the ice-making housing; and the fastening hook has predetermined elasticity and is provided on any one of the bottom surface of the door basket and the top surface of the ice-making housing corresponding to the ceiling or bottom of the mounting space.

In another embodiment of the invention, the water tank detachably installed to the rear surface of the door is guided by a guide means.

In another embodiment of the invention, the guide means includes: a guide rib provided on any one of the rear surface of the door and a top surface of the water tank in a direction in which the water tank is received or withdrawn; and a guide groove provided on the other of the rear surface of the door and the top surface of the water tank such that the guide rib is inserted in and slid along the guide groove in the direction in which the water tank is received or withdrawn.

In another embodiment of the invention, the water tank is detachably installed in a mounting space defined between a bottom surface of one of door baskets provided on the rear surface of the door and a top surface of the ice-making housing; a pair of the guide ribs are provided on the bottom surface of the door basket corresponding to the ceiling of the mounting space; and a pair of the guide grooves are formed on the top surface of the water tank.

In another embodiment of the invention, the ice tray is installed in the installation space to be pivotal on a pair of support shafts provided on both sides thereof and pivotally supported on inner sides of the ice-making housing.

In another embodiment of the invention, there is further comprising a tray cover installed in the installation space to selectively open or close the ice-making grooves.

In another embodiment of the invention, the tray cover is installed to be pivotable about tip ends of hinge brackets in accordance with a pivot motion of the ice tray by means of the hinge brackets extending from both sides of an end of the tray cover to allow the tip ends of the hinge brackets to be pivotally connected to inner sides of the ice-making housing.

In another embodiment of the invention, the tray cover is provided with a sealing rib extending a predetermined length downward from a front end on a bottom surface of the tray cover, and a peripheral rib extending a predetermined length perpendicular to an outer surface of the sealing rib; and the ice tray is provided with a sealing groove formed by downwardly depressing an end of the ice tray corresponding to the front end of the tray cover by a predetermined depth to allow a tip end of the sealing rib to be fitted therein, and a closely contact rib extending a predetermined length upward from a side of the ice tray adjacent to the sealing groove to allow an inner surface thereof to be brought into close contact with an outer surface of the sealing rib and a tip end thereof to be brought into close contact with a bottom surface of the peripheral rib.

In another embodiment of the invention, the tray cover further includes: a supply port formed at a position of the tray cover to allow the water stored in the water tank to be transferred to the ice tray therethrough; a water guide surface formed at a top surface of the tray cover adjacent to the supply port to guide the water into the supply port; and a guide portion formed at a position on the top surface of the tray cover corresponding to an outer periphery of the water guide surface to guide cold air supplied into the installation space into the ice tray through the supply port as well as to prevent the water stored in the water tank from being splashed while the water is supplied into the ice-making grooves of the ice tray through the supply port.

In another embodiment of the invention, a height of the guide portion supply is increased in a direction in which the cold air is supplied into the installation space.

In another embodiment of the invention, a cold air guide is connected between facing surfaces of the hinge brackets at a predetermined inclined angle toward the ice tray to guide the cold air supplied into the installation space toward the ice tray.

In another embodiment of the invention, the front end of the tray cover is provided with a shock absorbing member for absorbing shock generated when one side of the tray cover pivoting in accordance with a pivot motion of the ice tray comes into contact with one side of the ice-making housing.

In another embodiment of the invention, the ice bank is received in or withdrawn out of the installation space through a home bar provided in the door.

In another embodiment of the invention, the home bar includes: a home bar housing installed on the rear surface of the door below the ice-making housing and provided with a predetermined storage space; an opening formed by cutting out a portion of the door to communicate with the storage space and the installation space; and a home bar door for selectively opening or closing the opening, and the ice bank is received in or withdrawn out of the installation space through the opening.

In another embodiment of the invention, there is further comprising a guide frame installed within the installation space to guide the ice bank at a downwardly inclined angle toward the opening.

In another embodiment of the invention, there is further comprising a guide box guided by the guide frame and received in or withdrawn out of the installation space through the opening in a state where the ice bank is securely placed on the guide box.

In another embodiment of the invention, a pair of guide protrusions and a pair of guide slots are provided on both outer side surfaces of the guide box and both corresponding inner side surfaces of the guide frame, respectively, whereby the guide protrusions are inserted in and slid along the guide slots when the ice bank is moved in a direction in which the ice bank is received in or withdrawn out of the installation space.

In another embodiment of the invention, the guide protrusions are spaced apart from each other by a predetermined distance in a direction in which the ice bank is received in or withdrawn out of the installation space; and both ends of the guide slots are spaced apart from each other by a predetermined distance corresponding to the spaced distance of the guide protrusions.

In another embodiment of the invention, each of the guide slots includes a first horizontal section extending a predetermined length horizontally from a position on each side surface of the guide frame in a direction in which the ice bank is withdrawn out of the installation space, an inclined section extending a predetermined length from a front end of the first horizontal section a downwardly inclined angle in the withdrawal direction of the ice bank, and a second horizontal section extending a predetermined length horizontally from a front end of the inclined section in the withdrawal direction of the ice tray.

In another embodiment of the invention, the ice bank is formed into a hexahedral shape with an open top and provided with an ice storage space therein, and the guide box is formed into a hexahedral shape with open top, front and back in correspondence with the ice bank.

In another embodiment of the invention, cooperating protrusions and cooperating ribs are provided at rear ends of both the side surfaces of the ice bank and upper ends of both the side surfaces of the guide box, respectively, whereby the cooperating protrusions come into close contact with rear ends of the cooperating ribs and push the cooperating ribs to thereby allow the guide box to move together with the ice bank when the ice bank is moved in the withdrawal direction of the ice bank.

In another embodiment of the invention, a catching rib is provided at a front lower end of the ice bank; cooperating brackets are provided at lower ends of both sides on an open rear surface of the guide box, respectively; and the catching rib comes into close contact with a front end of a floor surface of the guide box to push the front end of the guide box and both sides of a rear lower end of the ice bank come into close contact with the cooperating brackets, respectively, to push the cooperating brackets when the ice bank is moved in a direction in which the ice bank is received in the installation space, whereby the guide box is moved together with the ice bank.

In another embodiment of the invention, at least one movement preventing groove is formed on any one of a bottom surface of the ice bank and the corresponding floor surface of the guide box in a direction in which the ice bank and the guide box are moved; and at least one movement preventing rib is formed on the other of the bottom surface of the ice bank and the floor surface of the guide box in the moving direction of the ice bank and the guide box, whereby the movement preventing rib is inserted in the movement preventing groove.

In another embodiment of the invention, an inclined portion is formed at the rear lower end of the ice bank at a downwardly inclined angle in the withdrawal direction of the ice bank to allow the ice bank, which is withdrawn out of the installation space through the opening in a state where the ice bank is securely placed on the guide box, to be moved at an upwardly inclined angle and thus the ice bank to be detached from the guide box.

According to another aspect of the present invention for achieving the objects, there is provided an ice-making device for a refrigerator, comprising: a water tank detachably mounted to a rear surface of a refrigerator door; an ice-making housing detachably mounted to the rear surface of the door below the water tank and provided with a predetermined installation space therein; an ice tray mounted into the installation space and formed with a plurality of ice-making grooves in which water supplied from the water tank is frozen into ice; a valve assembly operating to selectively supply water stored in the water tank to the ice tray when the water tank is installed or withdrawn; and an ice bank for storing ice made in the ice tray, the ice bank being installed in the installation space to be received in or withdrawn out of the installation space through a home bar provided on the door; a guide box installed in the installation space to be received in or withdrawn out of the installation space through the home bar in a state where the ice bank is securely placed on the guide box; and a guide frame installed in the installation space to guide the guide box with the ice bank placed thereon toward the home bar at a downwardly inclined angle.

In one embodiment of the invention, the water tank includes: a tank main body formed into a polyhedral shape with at least partially open top to define a water storage space therein and provided with a discharge port at a bottom surface thereof to allow the water store in the water tank to be supplied to the ice tray though the discharge port; a tank cover coupled to the open top of the tank main body to selectively open or close the water storage space and provided with a supply port at a predetermined position thereof to allow water to be supplied and stored in the water storage space; and a supply port cover pivotally installed to the tank cover to selectively open or close the supply port, and the water tank is detachably installed in a mounting space defined between a bottom surface of one of door baskets provided on the rear surface of the door and a top surface of the ice-making housing.

In another embodiment of the invention, the valve assembly includes: an actuating protrusion formed to extend a predetermined length on the bottom surface of the door basket or the top surface of the ice-making housing corresponding to the ceiling or bottom of the mounting space in a direction in which the water tank is received in or withdrawn out of the mounting space; a valve lever installed below the tank main body to allow a tip end thereof to be vertically pivoted with respect to a pivot end thereof within a predetermined range of angle and actuated by the actuating protrusion; a valve cover provided at the tip end of the valve lever positioned in the water storage space through the discharge port to selectively bring a bottom surface thereof into close contact with a floor surface of the water storage space by a pivot motion of the valve lever to thereby selectively open or close the discharge port; and a torsion spring for imparting an elastic force to the valve lever in a direction in the valve cover is pivoted to close the discharge port, and the valve lever is vertically pivoted by the actuating protrusion within a range from a position where the valve cover is brought into close contact with the floor surface of the water storage space adjacent to the discharge port to close the discharge port to a position where the valve cover is spaced apart from the floor surface of the water storage space to open the discharge port.

In another embodiment of the invention, a fastening hook with predetermined elasticity is provided on any one of the bottom surface of the door basket and the top surface of the ice-making housing corresponding respectively to the ceiling and bottom of the mounting space; a fastening protrusion is provided on a rear surface of the tank main body to be selectively and elastically fastened to the fastening hook; and the fastening protrusion is selectively and elastically fastened to the fastening hook when the water tank is received in or withdrawn out of the mounting space, whereby the water tank is not inadvertently detached from the mounting space.

In another embodiment of the invention, a pair of guide ribs are formed on the bottom surface of the door basket corresponding to the ceiling of the mounting space to extend in a direction in which the water tank is received or withdrawn; a pair of guide grooves are on the top surface of the tank main body to allow the guide ribs to be inserted in and slid along the guide grooves, respectively, in a direction the water tank is received or withdrawn; and the guide ribs are inserted in and slid along the guide grooves, respectively, when the water tank is received in or withdrawn out of the mounting space, whereby movement of the water tank is guided.

In another embodiment of the invention, there is further comprising a tray cover installed in the installation space and pivoted in accordance with a pivot motion of the pivotable ice tray installed in the installation space to selectively open or close the ice-making grooves.

In another embodiment of the invention, the tray cover includes: a water guide surface formed on a top surface of the tray cover corresponding to an outer periphery of a supply port to guide the water stored in the water tank into the supply port through which the water stored in the water tank is supplied to the ice tray; a guide portion formed on the top surface of the tray cover corresponding to an outer periphery of the water guide surface to guide cold air supplied into the installation space into the ice tray through the supply port as well as to prevent the water stored in the water tank from being splashed while the water is supplied into the ice-making grooves of the ice tray through the supply port; and a shock absorbing member formed at a front end of the tray cover to absorb shock generated when one side of the tray cover pivoting in accordance with the pivot motion of the ice tray comes into contact with one side of the ice-making housing.

In another embodiment of the invention, the tray cover is pivotally supported by hinge brackets extending from both sides of an end of the tray cover to allow tip ends of the hinge brackets to be pivotally connected to inner sides of the ice-making housing; and a cold air guide is connected between facing surfaces of the hinge brackets at a predetermined inclined angle toward the ice tray to guide the cold air supplied into the installation space toward the ice tray.

In another embodiment of the invention, a pair of guide protrusions are provided on both outer side surfaces of the guide box, respectively, to be spaced apart from each other by a predetermined distance in a direction in which the ice bank is received in or withdrawn out of the installation space; and a pair of guide slots are provided on both inner side surfaces of the guide frame, respectively, to be spaced apart from each other by a predetermined distance corresponding to the spaced distance of the guide protrusions, whereby the guide protrusions are inserted in and slid along the guide slots when the ice bank is moved in a direction in which the ice bank is received in or withdrawn out of the installation space.

In another embodiment of the invention, the ice bank is formed into a hexahedral shape with an open top and provided with an ice storage space, and includes cooperating protrusions protruding upward from rear ends of both side surfaces thereof and a catching rib extending downward from a front lower end thereof; the guide box is formed into a hexahedral shape with open top, front and back in correspondence with the ice bank, and includes cooperating ribs extending in opposite directions on upper ends of both the side surfaces thereof and cooperating brackets extending in opposite directions from lower ends of both sides on a rear surface of the guide box, respectively; and the cooperating protrusions come into close contact with rear ends of the cooperating ribs and push the cooperating ribs to thereby allow the guide box to move together with the ice bank when the ice bank is moved in a direction in which the ice bank is withdrawn, the catching rib comes into close contact with a front end of a floor surface of the guide box to push the front end of the guide box and both sides of a rear lower end of the ice bank come into close contact with the cooperating brackets, respectively, to push the cooperating brackets when the ice bank is moved in a direction in which the ice bank is received in the installation space, whereby the guide box is moved together with the ice bank.

Advantageous Effects

According to the present invention so configured, ice can be withdrawn in more simple and convenient way. In addition, power consumption when ice is taken out can be minimized. Further, ice can be made and stored in a more sanitary way. Furthermore, ice can be rapidly made.

BEST MODE

Hereinafter, a preferred embodiment of an ice-making device for a refrigerator and a refrigerator having the same according to the present invention will be described in detail with reference to the accompanying drawings.

Figure 1:
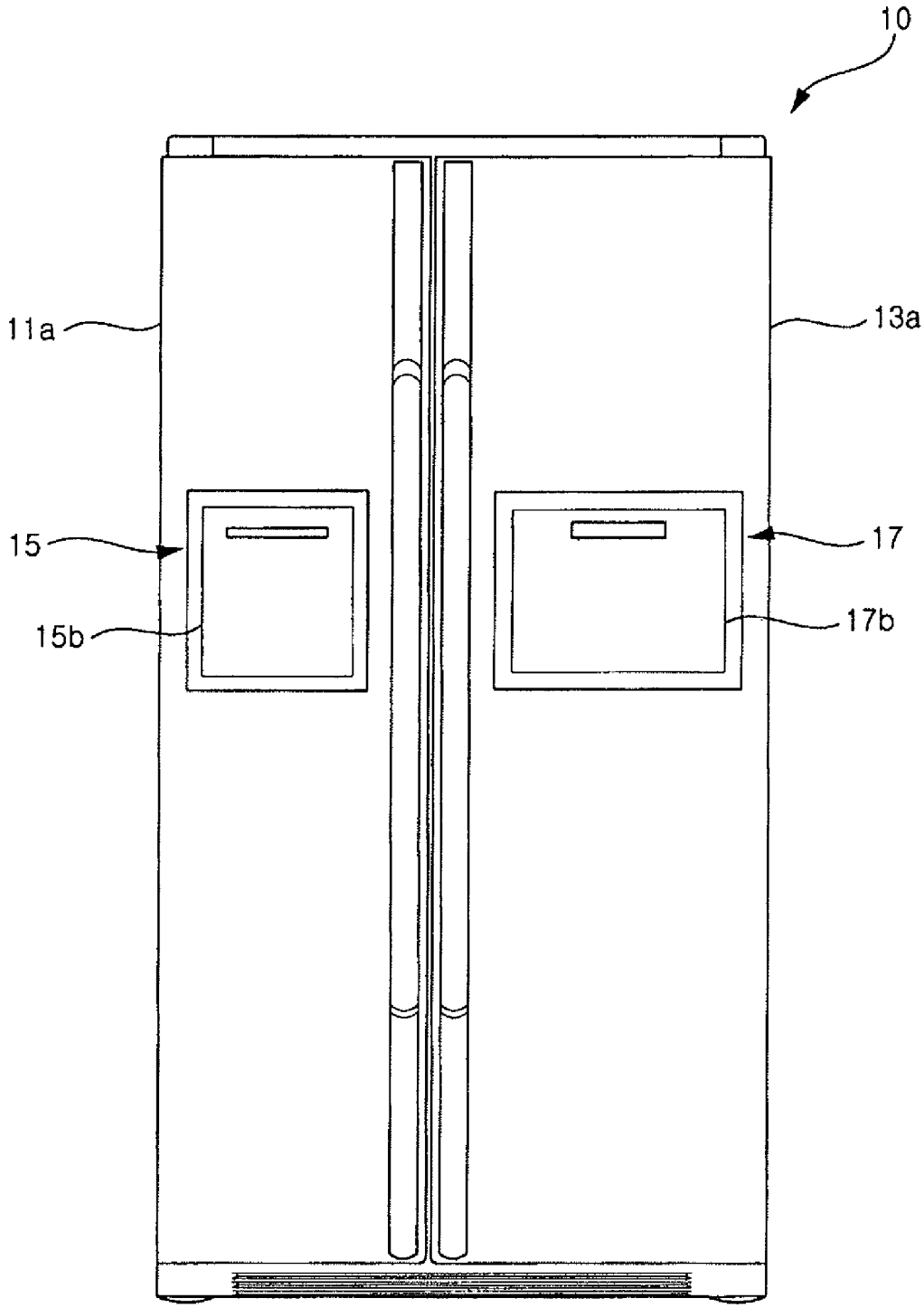
FIG. 1 Prior Art
FIG. 1 is a front view showing an external appearance of a refrigerator equipped with a related art ice-making device.
Figure 2:
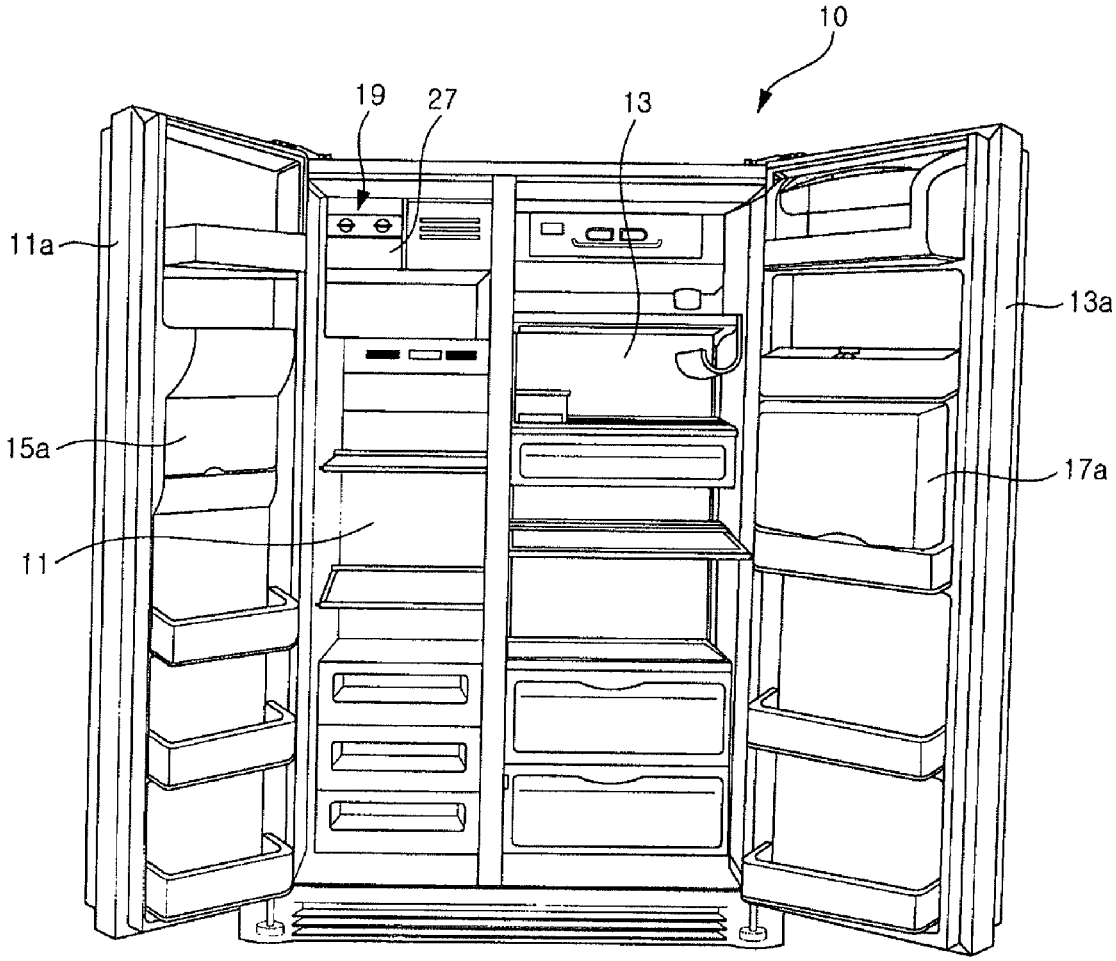
FIG. 2 Prior Art
FIG. 2 is a front view showing the interior of the refrigerator shown in FIG. 1.
Figure 3:
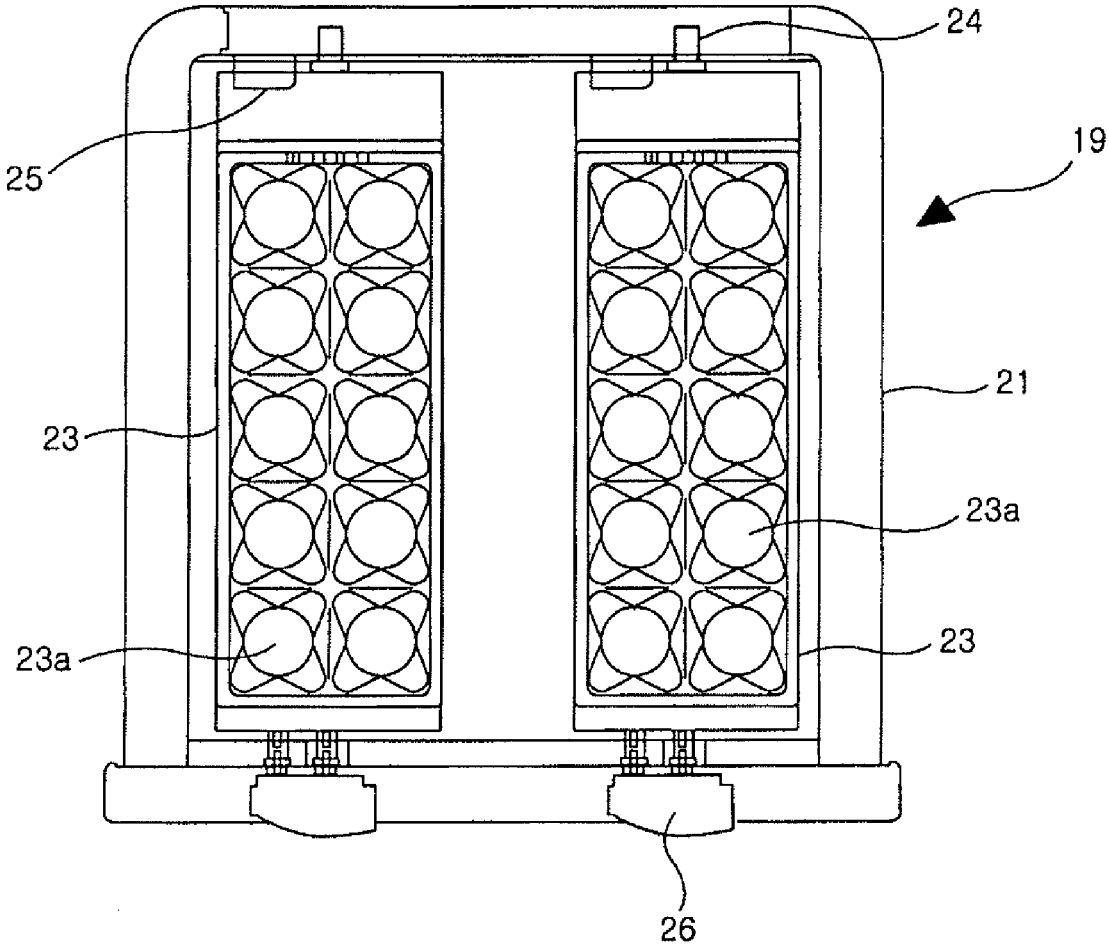
FIG. 3 Prior Art
FIG. 3 is a plan view of the ice-making device provided in the refrigerator shown in FIG. 2.
Figure 4:
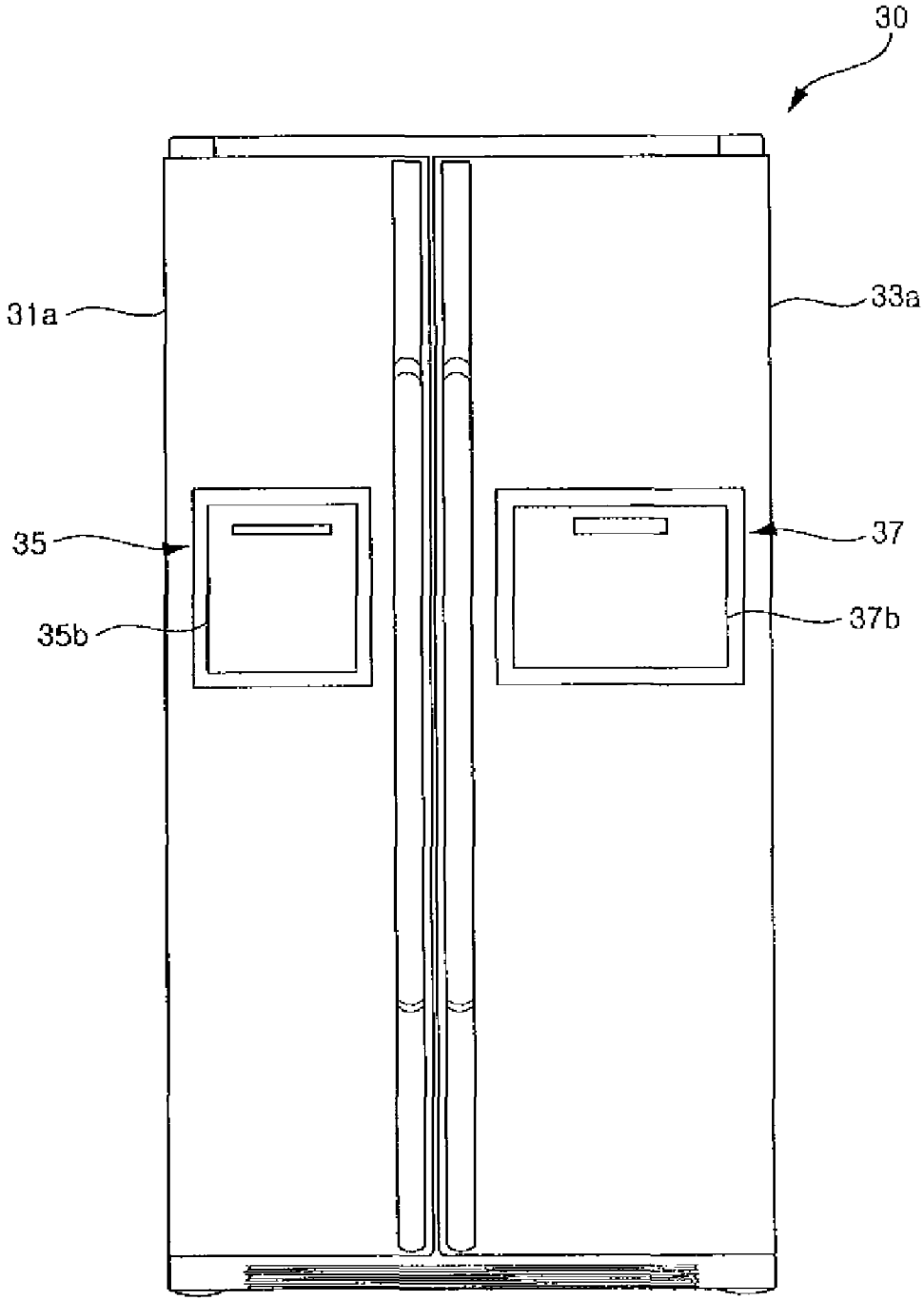
FIG. 4 is a front view showing an external appearance of a refrigerator equipped with a preferred embodiment of an ice-making device according to the present invention.
Figure 5:
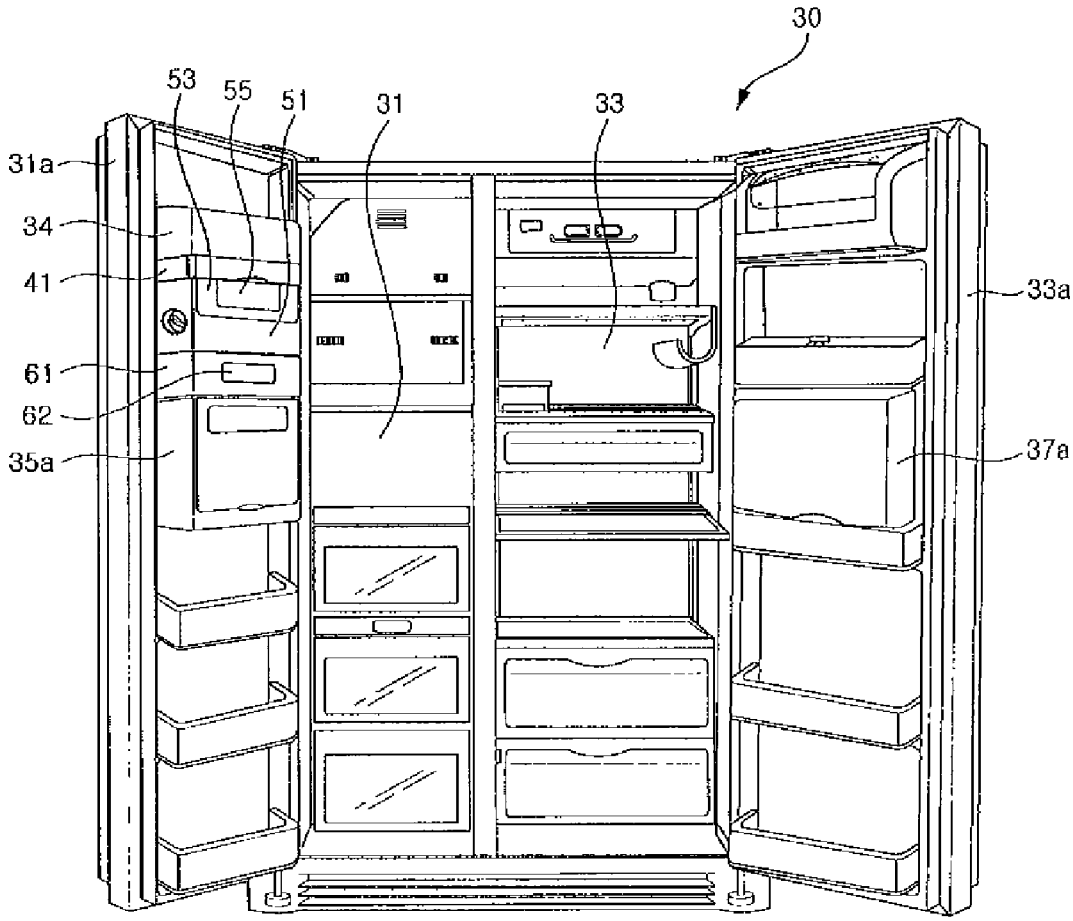
FIG. 5 is a front view showing the interior of a refrigerator equipped with a preferred embodiment of an ice-making device according to the present invention.
Figure 6:
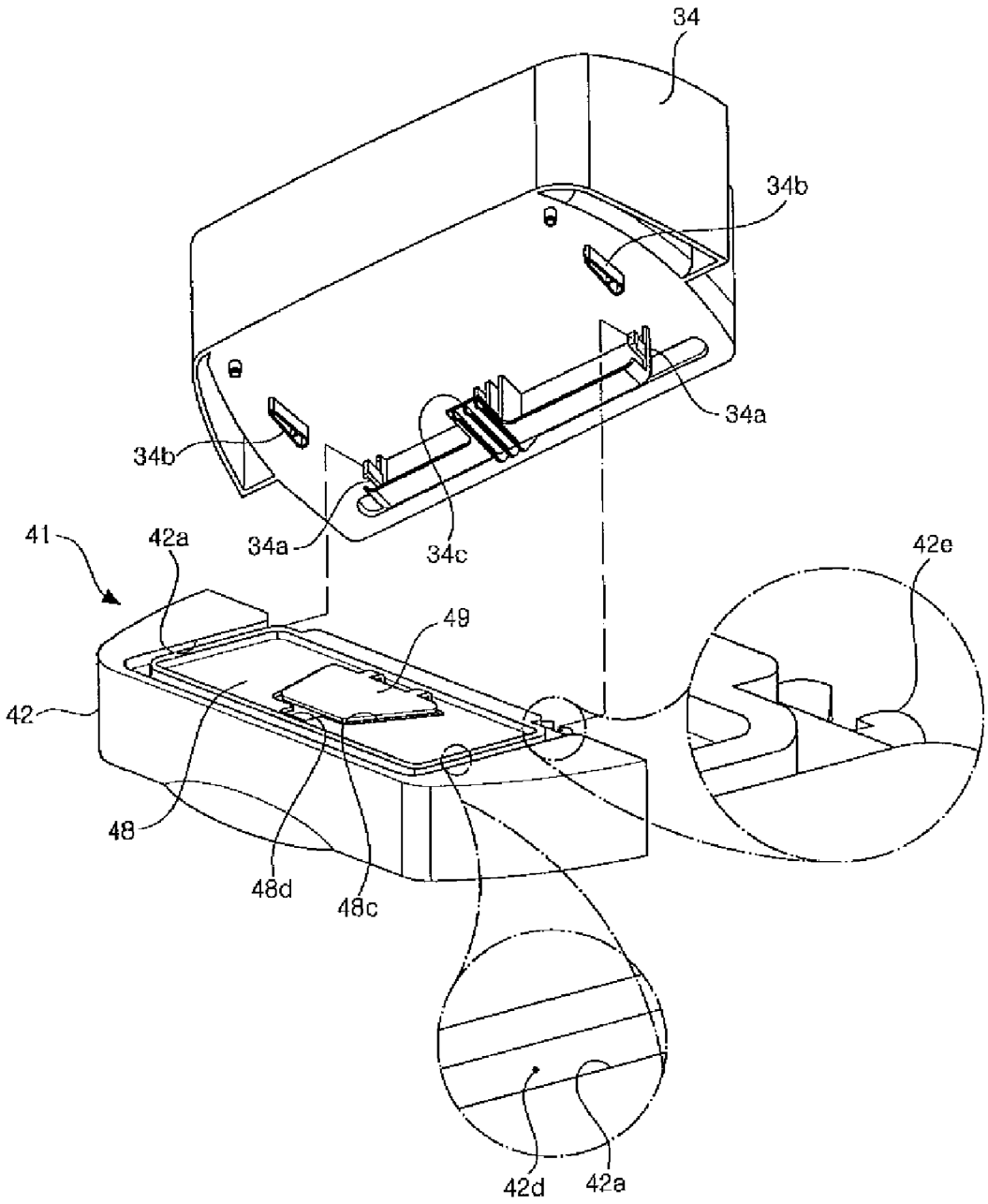
FIG. 6 is a perspective view showing a mounting structure of a water tank constituting the embodiment of the present invention shown in FIG. 5.
Figure 7:
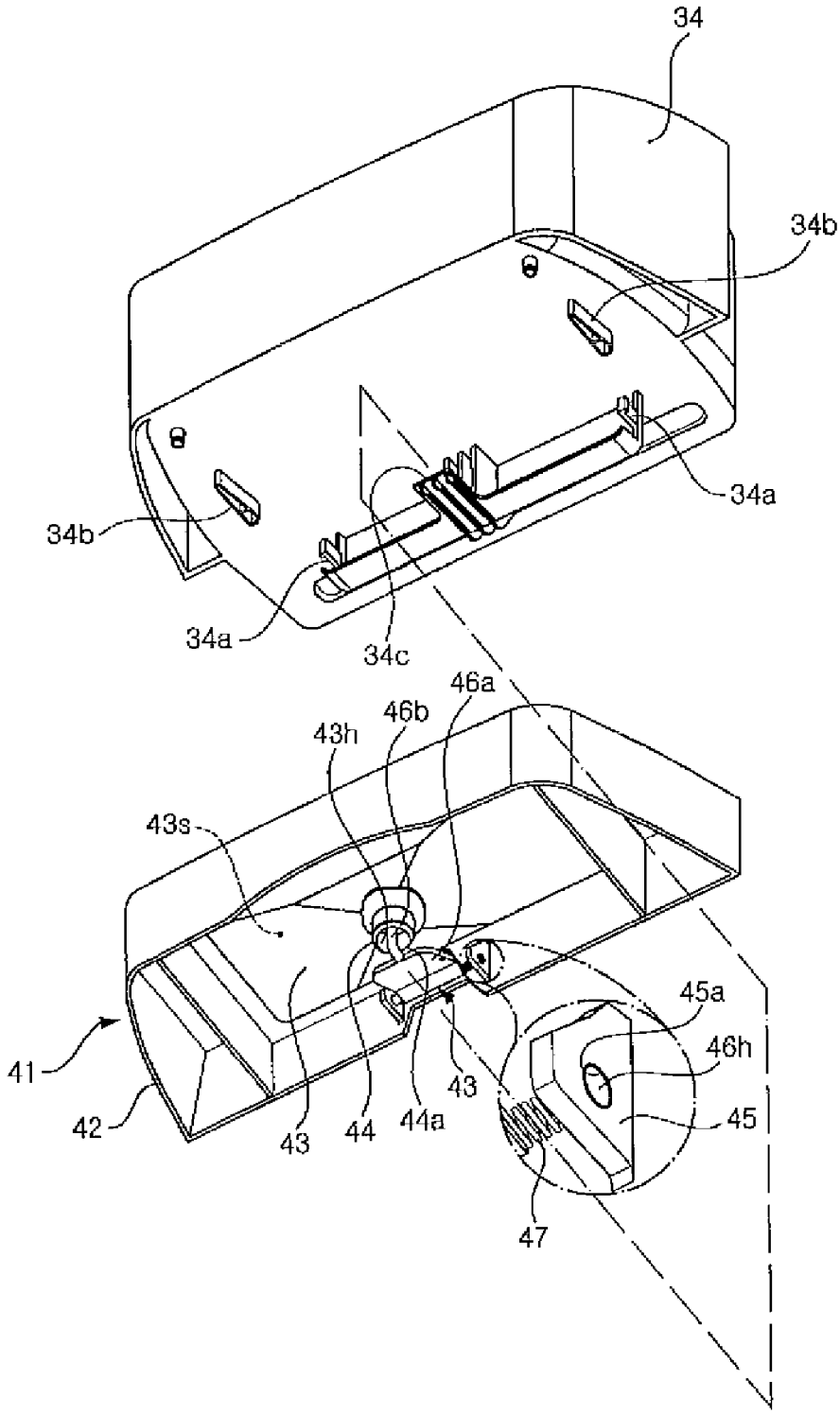
FIG. 7 is a perspective view showing a valve assembly constituting the embodiment of the present invention shown in FIG. 5.
Figure 8:
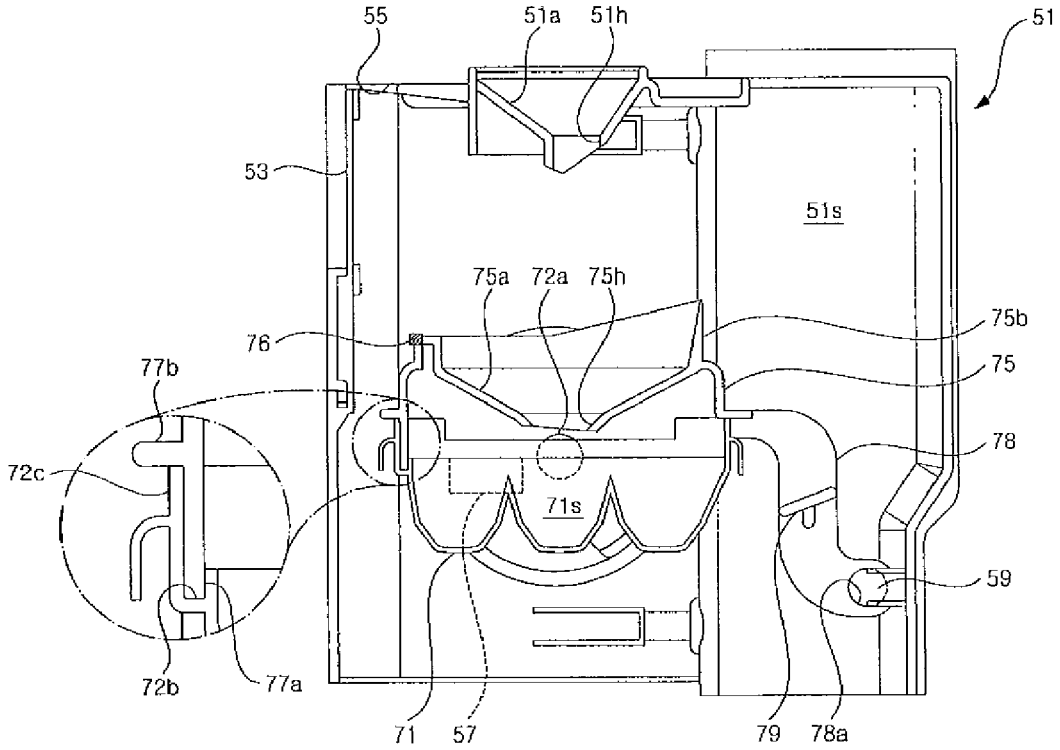
FIG. 8 is a side sectional view showing the interior of a first ice-making housing constituting the embodiment of the present invention shown in FIG. 5.
Figure 9:
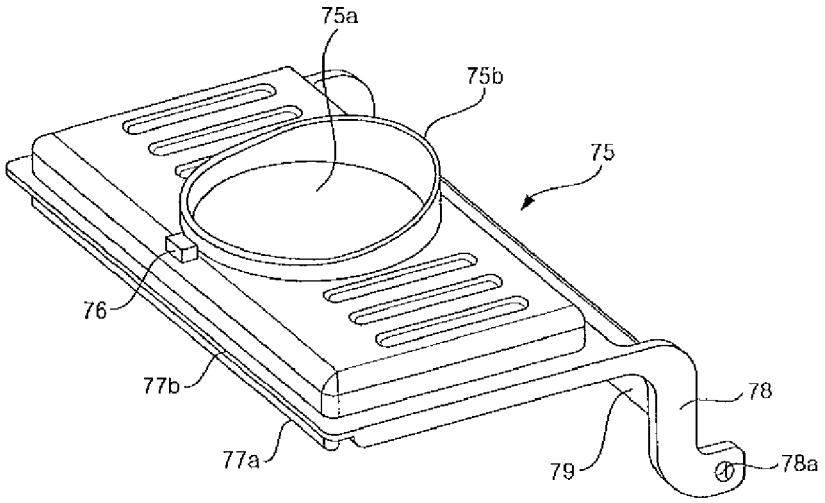
FIG. 9 is a perspective view showing a tray cover constituting the embodiment of the present invention shown in FIG. 5.
Figure 10:
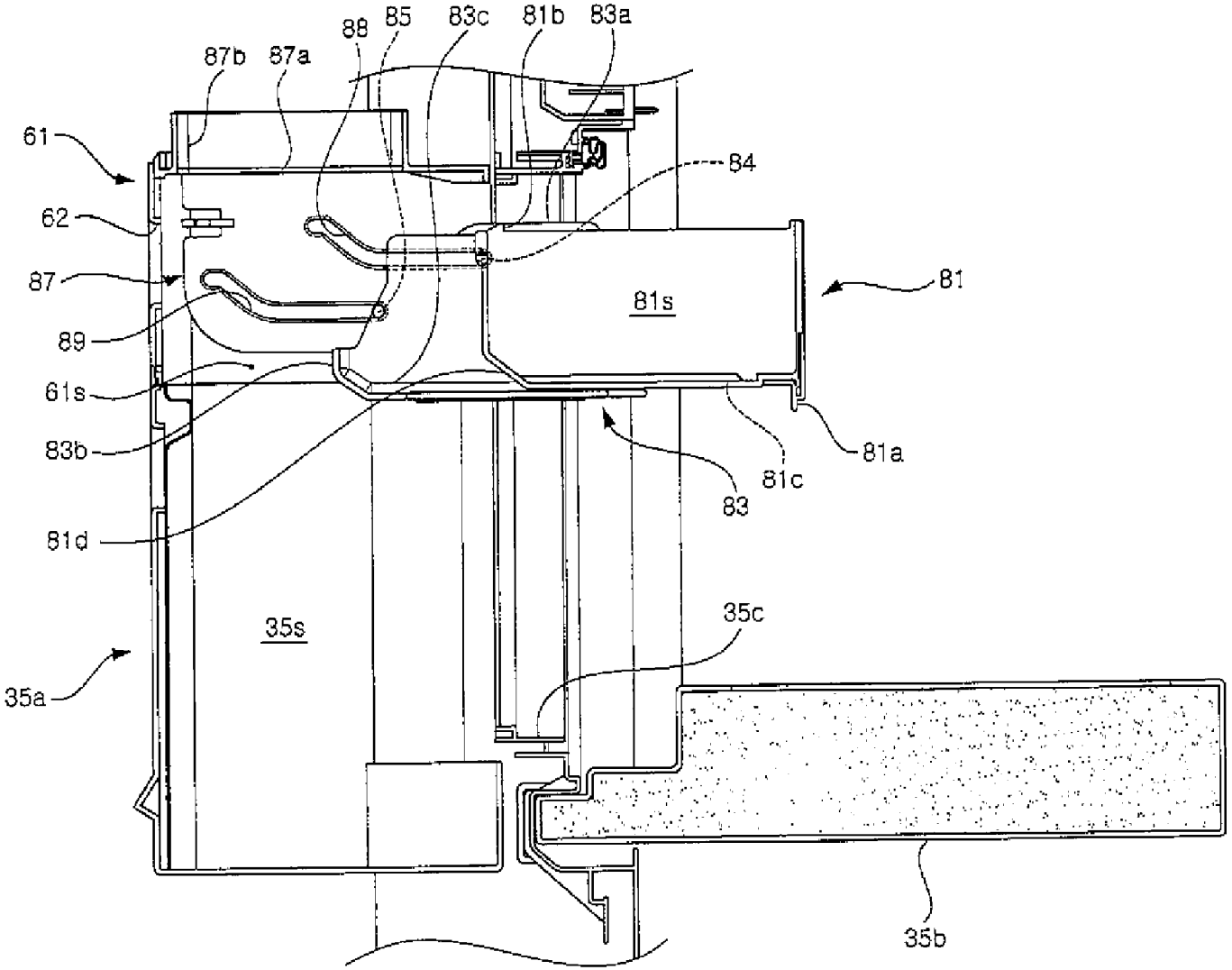
FIG. 10 is a side sectional view showing the interior of a second ice-making housing and a home bar housing constituting the embodiment of the present invention shown in FIG. 5.
Figure 11:
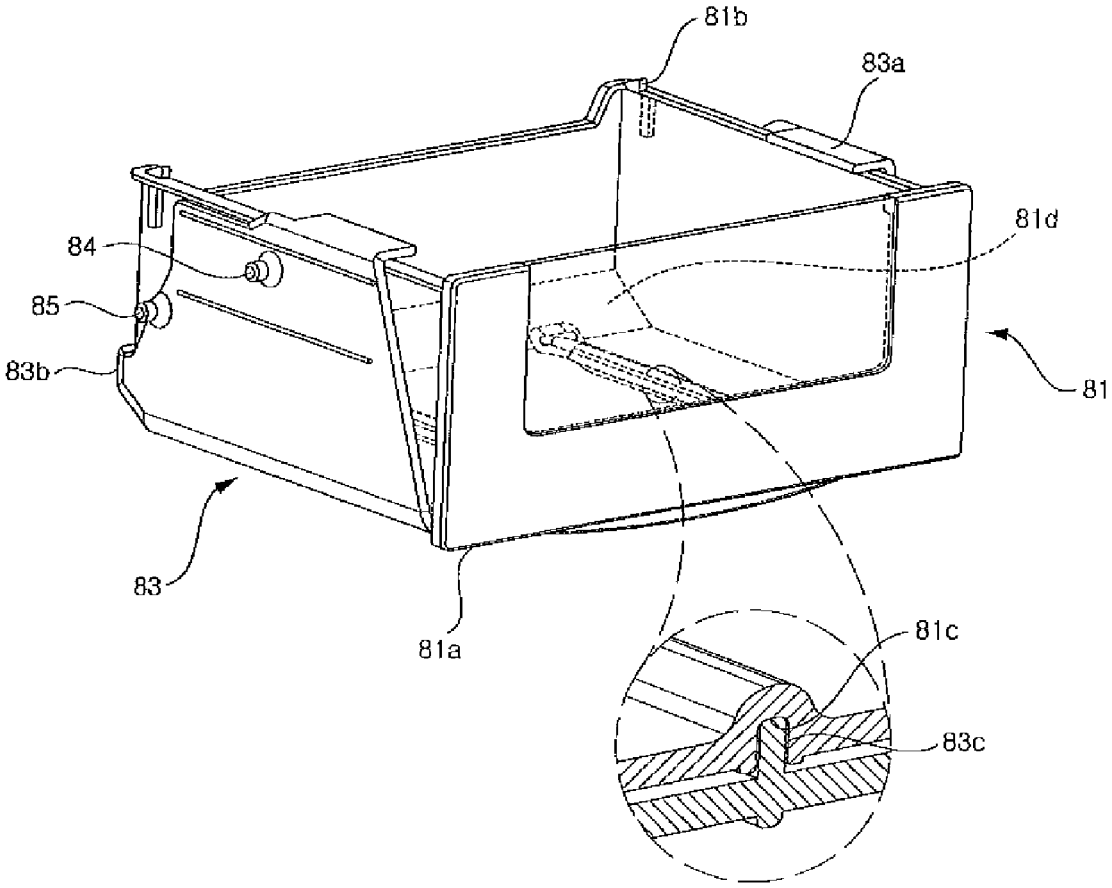
FIG. 11 is a perspective view illustrating a state where an ice bank is securely placed on a guide box according to the embodiment of the present invention shown in FIG. 5.
Figure 12:
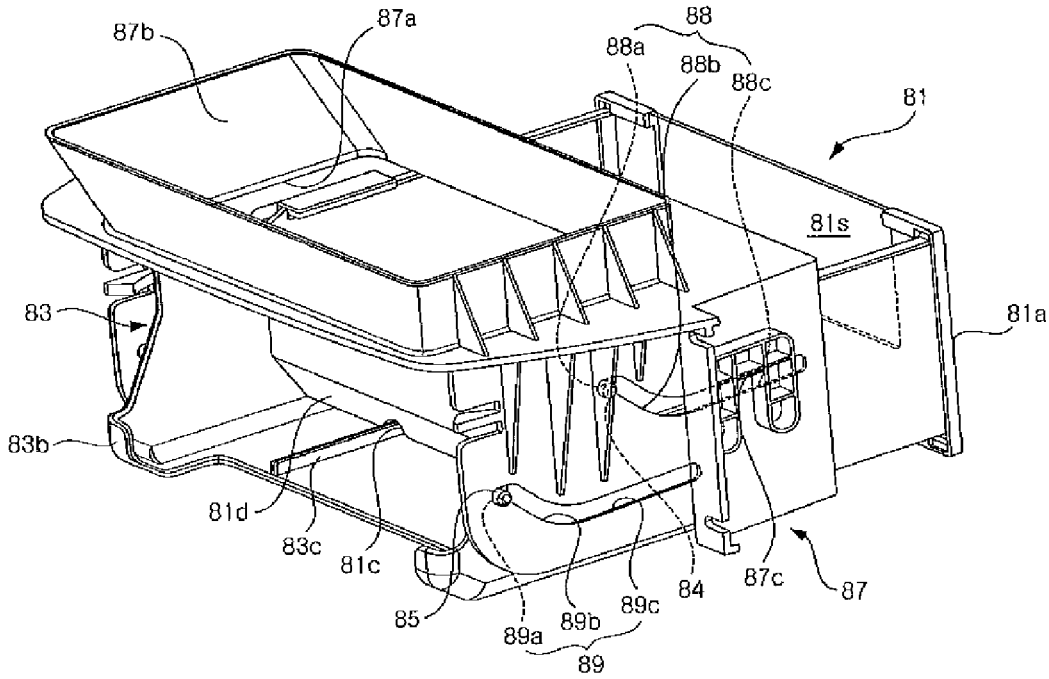
FIG. 12 is a perspective view showing a guide frame constituting the embodiment of the present invention shown in FIG. 5.

FIGS. 4 and 5 show a refrigerator equipped with a preferred embodiment of an ice-making device for a refrigerator according to the present invention, FIG. 6 shows a mounting structure of a water tank constituting the embodiment of the present invention shown in FIG. 5, FIG. 7 shows a valve assembly constituting the embodiment of the present invention shown in FIG. 5, FIG. 8 shows the interior of a first ice-making housing constituting the embodiment of the present invention shown in FIG. 5, FIG. 9 shows a tray cover constituting the embodiment of the present invention shown in FIG. 5, FIG. 10 shows the interior of a second ice-making housing and a home bar housing constituting the embodiment of the present invention shown in FIG. 5, FIG. 11 illustrates a state where an ice bank is securely placed on a guide box according to the embodiment of the present invention shown in FIG. 5, and FIG. 12 shows a guide frame constituting the embodiment of the present invention shown in FIG. 5.

As shown in the figures, freezing and refrigerating chambers 31 and 33 are provided within a main body 30 of a refrigerator. The freezing and refrigerating chambers 31 and 33 are partitioned side by side within the main body 30. Further, freezing and refrigerating chamber doors 31*a* and 33*a* are hinged to opposite lateral sides of the main body 30, respectively, such that the doors can be horizontally pivoted. The freezing and refrigerating chamber doors 31*a* and 33*a* serve to selectively open or close the freezing and refrigerating chambers 31 and 33, respectively.

Referring to FIG. 5, support sidewalls 31*b* and 33*b* are provided at opposite side ends on rear surfaces of the freezing and refrigerating chamber doors 31*a* and 33*a*, respectively. Each of the support sidewalls 31*b* and 33*b* is formed in such a manner that a portion of a door liner constituting an outer appearance of the rear surface of the door 31*a* or 33*a* protrudes rearward by a predetermined height. A plurality of fixing protrusions (not shown) are provided at corresponding positions on opposite surfaces of each of the supporting sidewalls 31*b* and 33*b*, respectively.

A plurality of door baskets are provided on the rear surface of the freezing or refrigerating chamber door 31*a* or 33*a* between the support sidewalls 31*b* or 33*b*. An accommodating space for accommodating foods therein is formed in each of the door baskets. The door baskets are detachably installed on the rear surfaces of the freezing and refrigerating chamber doors 31*a* and 33*a*, respectively.

Referring to FIGS. 6 and 7, a pair of fastening hooks 34*a* are formed at a rear end on a bottom surface of the door basket 34 provided at an uppermost portion on the rear surface of the freezing chamber door 31*a*. The fastening hooks 34*a* are to prevent a water tank 41 to be explained later from being inadvertently detached at a state where the water tank is mounted into a mounting space S to be explained later. The fastening hooks 34*a* extend rearward of the refrigerator door 31*a*, i.e. in a direction in which the water tank 41 is detached, at both sides of the rear end on the bottom surface of the door basket 34 adjacent to the rear surface of the freezing chamber door 31*a*. Each of the fastening books 34*a* has predetermined elasticity in a direction perpendicular to the mounting direction of the water tank 41.

Further, a pair of guide ribs 34*b* are formed at both ends on the bottom surface of the door basket 34 in front of the fastening hooks 34*a*. The guide ribs 34*b* are to guide mounting of the water tank 41. The guide ribs 34*b* are spaced apart from each other by a predetermined distance in a width direction of the freezing chamber door 31*a*, i.e. in a direction perpendicular to the mounting direction of the water tank 41, and extend in a thickness direction of the freezing chamber door 31*a*, i.e. in the mounting direction of the water tank 41.

An actuating protrusion 34*c* is provided in the middle of the rear end on the bottom surface of the door basket 34. The actuating protrusion 34*c* extends rearward of the freezing chamber door 31*a*, i.e. in the direction in which the water tank 41 is detached, at the middle of the rear end on the bottom surface of the door basket 34 adjacent to the rear surface of the freezing chamber door 31*a*, i.e. at the middle of the rear end on the bottom surface of the door basket 34 corresponding to between the fastening hooks 34*a*. The actuating protrusion 34*c* serves to actuate a valve lever 46 to be explained later.

As shown in FIGS. 4 and 5, home bars 35 and 37 are provided in the freezing and refrigerating chamber doors 31*a* and 33*a*, respectively. The home bars 35 and 37 are used to receive or withdraw foods such as drinking water without opening the freezing and refrigerating chamber doors 31*a* and 33*a*, respectively. The home bar 35 or 37 comprises a home bar housing 35*a* or 37*a* and a home bar door 35*b* or 37*b*.

The home bar housing 35*a* or 37*a* is generally formed into a polyhedral shape with the open top and front that is brought into close contact with the rear surface of the freezing or refrigerating chamber door 31*a* or 33*a*. The home bar housing 35*a* or 37*a* is provided on the rear surface of the freezing or refrigerating chamber door 31*a* or 33*a* corresponding to between the support sidewalls 31*b* or 33*b*. A storage space 35*s* or 37*s* for accommodating drinking water and the like is defined within the home bar housing 35*a* or 37*a*.

Further, an opening 35*c* or 37*c* is formed by cutting out a portion of the freezing or refrigerating chamber door 31*a* or 33*a*. The opening 35*e* formed in the freezing chamber door 31*a* communicates with the storage space 35*s* of the home bar housing 35*a* and an installation space 61*s* of a second ice-making housing 61 to be explained later. Through the opening 35*c*, therefore, food is received into or withdrawn out of the storage space 35*s* of the home bar housing 35*a*, or an ice bank 81 to be explained later is received in or withdrawn out of the installation space 61*s* of the second ice-making housing 61. The opening 37*c* formed in the refrigerating chamber door 33*a* communicates with the storage space 37*s* of the home bar housing 37*a*. Through the opening 37*c*, therefore, food is received into or withdrawn out of the storage space 37*s* of the home bar housing 37*a*.

The home bar door 35*b* or 37*b* is installed on a front surface of the freezing or refrigerating chamber door 31*a* or 33*a* such that home bar door can be vertically pivoted. The home bar doors 35*b* and 37*b* serve to selectively open or close the openings 35*c* and 37*c*, respectively. In particular, the home bar door 35*b* installed to the freezing chamber door 31*a* allows the storage space 35*s* of the home bar housing 35*a* and the installation space 61*s* of the second ice-making housing 61 to be selectively opened or closed.

Furthermore, the mounting space S is defined between the door basket 34 and the first ice-making housing 51 to be explained later. That is, the mounting space S is substantially defined between the bottom surface of the door basket 34 and a top surface of the first ice-making housing 51, which are vertically spaced apart by a predetermined distance.

The water tank 41 is detachably installed within the mounting space S. The water tank 41 is filled with water which in turn will be supplied to an ice tray 71. As shown in FIGS. 6 and 7, a tank main body 42 of the water tank 41 is formed into a hollow polyhedral shape. A cover seating portion 42*a* is provided on a top surface of tank main body 42. The cover seating portion 42*a* is formed in such a manner that a central portion on the top surface of the tank main body 42 is stepped downward with respect to the other portions on the top surface of the tank main body 42.

Figure 13:
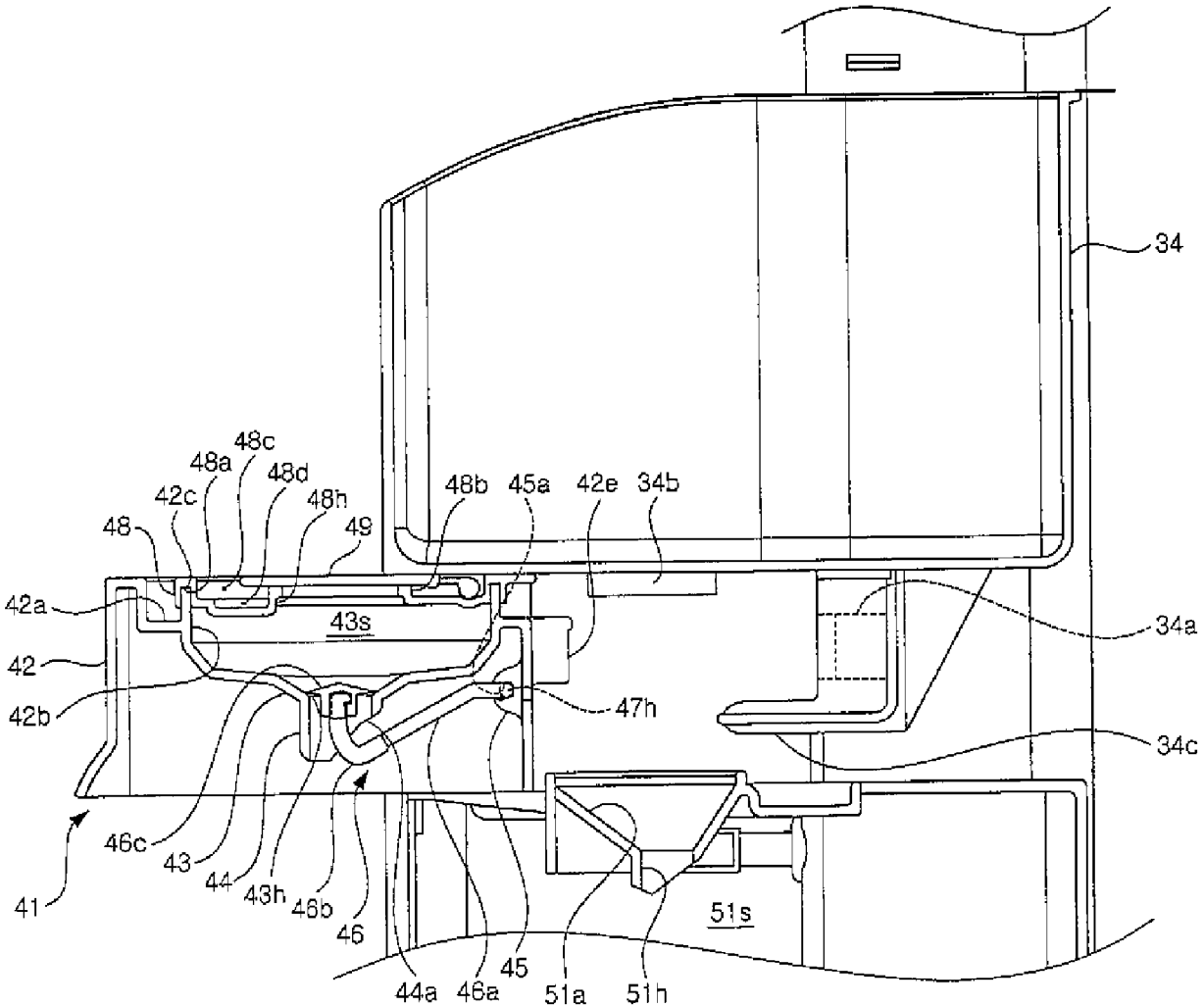
FIGS. 13 and 14 are side sectional views illustrating a mounting process of a water tank constituting the embodiment of the present invention shown in FIG. 5.

An opening 35*c* (FIG. 13) is defined within the cover seating portion 42*a*. The opening 35*c* functions as an inlet through which water is stored in a water storage space 43*s* to be explained later. The cover seating portion 42*a* corresponding to an edge of the opening is provided with an upwardly extending insertion rib 42*c* (FIG. 13).

A pair of guide grooves 42*d* are formed on the top surface of the tank main body 42. Each of the guide grooves 42*d* extends lengthwise in the mounting direction of the water tank 41. When the water tank 41 is mounted into the mounting space S, the guide ribs 34*b* of the door basket 34 are inserted into and slid along the guide grooves 42*d*, respectively. In the illustrated embodiment, the guide groove 42*d* is substantially defined by a floor surface and both side surfaces of the cover seating portion 42*a* and both side surfaces of a tank cover 48 to be explained later.

As shown in an enlarged portion of FIG. 6, fastening protrusions 42*e* are provided at both ends on a rear surface of tank main body 42 corresponding to the rear surface of the freezing chamber door 31*a*, respectively. The fastening protrusions 42*e* are elastically fastened to the fastening hooks 34*a* of the door basket 34 in a state where the water tank 41 is mounted into the mounting space S.

As also shown in FIG. 7, a water storing portion 43 is defined within the tank main body 42. The water storing portion 43 is formed with the water storage space 43*s* in which a predetermined amount of water (i.e., an amount of water required for making ice one time in the ice tray 71) is stored. The water storing portion 43 is formed into a hopper shape extending downward from the edge of the opening 35*c*. In practice, the insertion rib 42*c* and the water storing portion 43 are integrally formed with the tank main body 42. The shapes of the insertion rib 42*c* and the water storing portion 43 are shown in more detail in FIG. 13.

It is preferred that at least a portion of the tank main body 42 (and/or the tank cover 48, a supply port cover 49) be formed of a transparent or translucent material. The reason is that a user can check an amount of water stored in the water storage space 43*s* from the outside.

A discharge port 43*h* is provided at the central bottom of the water storage portion 43. Water stored in the water storage space 43*s* is supplied to the ice tray 71 through the discharge port 43*h* of the water tank 41. The discharge port 43*h* of the water tank 41 is preferably positioned above a guiding inclined portion 51*a* of the first ice-making housing 51 when the water tank 41 is mounted into the mounting space S.

A valve guide 44 is provided on a bottom surface of the water storing portion 43 corresponding to an outer periphery of the discharge port 43*h* of the water tank 41. The valve guide 44 serves to guide movement of a valve protrusion 46*b* to be explained later. The valve guide 44 is generally formed into a cylindrical shape. Further, a cutout 44*a* is formed at one side of the valve guide 44. The cutout 44*a* is used to avoid the interference of the valve protrusion 46*b*. The cutout 44*a* is cut away in such a manner that a portion of the valve guide 44 is inclined upward and rearward.

A pair of hinge pieces 45 are provided at the middle of a lower end on an inner rear side of the tank main body 42. Each of the hinge pieces 45 extends forward from the inner rear side of the tank main body 42 by a predetermined distance. The hinge piece 45 serves to pivotally support the valve lever 46. Each of the hinge pieces 45 is formed with a hinge hole 45*a*.

The valve lever 46 is provided to selectively open or close the discharge port 43*h*. The valve lever 46 is installed to and vertically pivoted on the inner rear side of the tank main body 42. The valve lever 46 is composed of a lever main body 46*a* and the valve protrusion 46*b*.

The lever main body 46*a* is formed into a plate with a predetermined area. Hinge protrusions 46*h* are provided at both rear ends of the lever main body 46*a*, respectively. Each of the hinge protrusions 46*h* is rotatably fitted into the hinge hole 45*a* of the hinge piece 45. When the water tank 41 is mounted into the mounting space S, the lever main body 46*a* is actuated by means of the actuating protrusion 34*c* and then vertically pivoted about the hinge protrusion.

The valve protrusion 46*b* is generally formed into an L shape. One end of the valve protrusion 46*b* is fixed to a front end of the lever main body 46*a*. The other end of the valve protrusion 46*b* is positioned within the water storage space 43*s* upward through the discharge port 43*h* of the water tank 41. The valve protrusion 46*b* is vertically moved as the valve lever 46 is pivoted. To this end, the valve protrusion 46*b* is formed to have a diameter relatively smaller than that of discharge port 43*h* of the water tank 41.

A valve cover 46*c* (FIG. 13) is provided at a tip end of the valve protrusion 46*b*. In practice, the discharge port 43*h* of the water tank 41 is selectively opened or closed by the valve cover 46*c*. To this end, the valve protrusion 46*b* is formed into a disk with a diameter relatively greater than that of the discharge port 43*h* of the water tank 41. The valve cover 46*c* is vertically moved in accordance with the movement of the valve lever 46. When the valve cover 46*c* is vertically moved, a bottom surface of the valve cover 46*c* is selectively brought into close contact with a bottom surface of the water storing portion 43 adjacent to the discharge port 43*h* of the water tank 41 to thereby selectively open or close the discharge port 43*h* of the water tank 41.

If the valve lever 46 is moved upward in a state where the discharge port 43*h* of the water tank 41 is closed by the valve cover 46*c*, the valve cover 46*c* is also moved upward. Therefore, a bottom surface of the valve lever 46 is spaced apart from a floor surface of the water storing portion 43, and thus, the discharge port 43*h* of the water tank 41 is opened. On the other hand, if the valve lever 46 is moved downward in a state where the discharge port 43*h* of the water tank 41 is not closed by the valve cover 46*c*, the valve cover 46*c* is also moved downward. Therefore, the bottom surface of the valve lever 46 is brought into close contact with the floor surface of the water storing portion 43, and thus, the discharge port 43*h* of the water tank 41 is closed.

The tip end of the valve lever 46 is preferably inclined downward toward the front of the water tank 41 at a predetermined angle in a state where the discharge port 43*h* of the water tank 41 is closed. The reason is that the valve lever 46 can be more easily actuated by means of the actuating protrusion 34*c* of the door basket 34 when the water tank 41 is mounted into the mounting space S.

A torsion spring 47 is provided at any one of the hinge protrusions 46*h* of the valve lever 46. The torsion spring 47 serves to apply a resilient force to the valve lever 46 in a direction in which the discharge port 43*h* of the water tank 41 is closed by the valve cover 46*c*, i.e. in a downward direction as viewed in FIG. 7. In a state where the water tank 41 is not mounted into the mounting space S, i.e. in a state where the valve lever 46 is not actuated by the actuating protrusion 34*c* of the door basket 34, therefore, the valve cover 46*c* is still maintained due to the resilient force of the torsion spring 47 at a state where the discharge port 43*h* of the water tank 41 is closed. To this end, both ends of the torsion spring 47 are supported on the inner rear side of the tank main body 42 and a top surface of the valve main body 46*a*, respectively.

Referring again to FIG. 6, the tank cover 48 is coupled to the top surface of the tank main body 42. The tank cover 48 is coupled to an upper portion of the tank main body 42 to selectively open or close the water storage space 43*s*, i.e. the opening 35*c* of the tank main body 42. An insertion groove 48*a* (FIG. 13) is formed at an edge of a bottom surface of the tank cover 48. The insertion rib 42*c* is inserted in the insertion groove 48*a*.

Each of side surfaces of the tank cover 48 are spaced apart the side surface of the cover seating portion 42*a* by a predetermined distance corresponding to a width of the guide groove 42*d* in a state where it is coupled to the tank main body 42. Further, a top surface of the tank cover 48 is preferably coplanar with other portions of the top surface of the tank main body 42 except the cover seating portion 42*a* in a state where it is coupled to the tank main body 42.

A supply port 48*h* (FIG. 13) is provided at one side of the tank cover 48. Water supplied from an external source (not shown) is stored in the water storage space 43*s* through the supply port 48*h* of the tank cover 48. A packing rib 48*b* is provided on the top surface of the tank cover 48 adjacent to an outer periphery of the supply port 48*h* of the tank cover 48. The packing rib 48*b* is formed in such a manner that it protrudes upward from the top surface of the tank cover 48 adjacent to the supply port 48*h* pf the tank cover 48.

A seating step 43*b* is formed on the top surface of the tank cover 48. The seating step 43*b* is formed in such a manner that a portion of the top surface of the tank cover 48 including the supply port 48*h* and the packing rib 48*b* of the tank cover 48 is depressed downward at predetermined height.

The tank cover 48 is provided with a supply port cover 49. The supply port cover 49 serves to selectively cover the supply port 48*h* of the tank cover 48*h*. To this end, the supply port cover 49 is vertically pivoted about a specific position on the top surface of the tank cover 48. The supply port cover 49 is securely placed on the seating step 43*b* in a state where the supply port 48*h* of the tank cover 48 is closed. Further, an edge of a bottom surface of the supply port cover 49 is brought into close contact with an upper end of the packing rib 48*b*.

A handle recess 48*d* is formed on the tank cover 48. The handle recess 48*d* communicates with the seating step 43*b*. The handle recess 48*d* is a portion in which a user's hand is inserted to allow the supply port cover 49 to be pivoted about the tank cover 48. Therefore, the handle recess 48*d* is preferably formed by depressing downward a portion of the tank cover 48 relatively further than the seating step 43*b*.

Referring again to FIG. 5, an ice-making housing is provided on the rear surface of the freezing chamber door 31*a* above the home bar housing 35*a*. The ice-making housing includes first and second ice-making housings 51 and 61. As also shown in FIGS. 8 and 10, installation spaces 51*s* and 61*s* are defined within the first and second ice-making housings 51 and 61, respectively. The first ice-making housing 51 is detachably installed on the rear surface of the freezing chamber door 31*a* between the support sidewalls 31*b* of the freezing chamber door 31*a*. To this end, fixing grooves (not shown) are formed on both external side surfaces of the first ice-making housing 51. The fixing protrusions of the support sidewalls 31*b* are fitted into the fixing grooves. Each of the fixing grooves is formed into a Π-shape with an open bottom. Therefore, the first ice-making housing 51 is detachably installed to the rear surface of the freezing chamber door 31*a* while moving vertically along the support side walls.

The first ice-making housing 51 is positioned below the door basket 34. As described above, since the first ice-making housing 51 is installed at a position downward below the door basket 34 by a predetermined height, the mounting space S into which the water tank 41 can be mounted is created between the first ice-making housing 51 and the door basket 34.

Referring again to FIG. 8, the first ice-making housing 51 is formed into a polyhedral shape with an open bottom. The guiding inclined portion 51*a* is provided on the top surface of the first ice-making housing 51. A supply port 51*h* is formed at a lower end of the guiding inclined portion 51*a*. The guiding inclined portion 51*a* is shaped into a hopper extending from the top surface of the first ice-making housing 51 to the interior of the installation space 51*s* by a predetermined length. The guiding inclined portion 51*a* serves to guide water supplied from the water tank 51 into the supply port 51*h* of the first ice-making housing 51 such that the water can be supplied into the installation space 51*s* of the first ice-making housing 51.

Further, a viewing window 53 is provided in a front surface of the first ice-making housing 51. The viewing window 53 is formed of a transparent or translucent material. The viewing window 53 functions to visually check a process of making ice in the ice tray 71 to be explained later.

A handle opening 55 is formed at an upper front edge of the first ice-making housing 51. The handle opening 55 is formed by cutting out a portion of the top surface of the first ice-making housing 51 corresponding to a rear end of the mounting space S and a portion of an upper end of the viewing window 53. The handle opening 55 is a portion through which a user's hand can pass to mount or withdraw the water tank 61. Further, cold air in the freezing chamber 31 can be supplied into the installation space 51*s* of the first ice-making housing 51 through the handle opening 55. That is, the handle opening 55 substantially functions as a cold air supply port. However, it is apparent that an additional cold air supply port may be provided at one side of the first ice-making housing 51.

Stoppers 57 are also provided on both inner sides of the first ice-making housing 51. Each of the stoppers 57 protrudes into the installation space 51*s* by a predetermined length from the inner side of the first ice-making housing 51. The stoppers 57 serve to support the ice tray 71 and also to allow the ice tray 71 to be twisted after the ice tray has been pivoted by a predetermined angle.

In addition, a pair of hinge pins 59 are provided on both inner rear sides of the first ice-making housing 51. Each of the hinge pins 59 extends a predetermined length in a lateral direction. The hinge pin 59 is pivotally inserted into a hinge hole 78*a* of a hinge bracket 78.

Meanwhile, the ice tray 71 is installed in the installation space 51*s* of the first ice-making housing 51. The ice tray 71 is formed into a rectangular shape. The ice tray 71 is provided with a plurality of ice-making grooves 71*s*. The ice tray 71 is pivotally installed in the installation space 5 is of the first ice-making housing 51.

To this end, support shafts 72*a* are provided on short sides of the ice tray 71, respectively. A tip end of the support shaft 72*a* is pivotally supported on each of the inner sides of the first ice-making housing 51. As shown in FIG. 5, a pivoting lever 73 is provided on an outer side of the first ice-making housing 51 corresponding to a pivoting end of the freezing chamber door 31*a*. The pivoting lever 73 is connected to any one of the support shafts 72*a* of the ice tray 71. Therefore, a user can rotate the pivoting lever 74 with his/her hand such that the ice tray 71 connected to the pivoting lever through the support shaft 72*a* can be pivoted.

The ice tray 71 is supported in a horizontal state by the stopper 57. Therefore, the ice tray 71 can be pivoted only in one direction by means of an external force for allowing the pivoting lever 73 to be pivoted.

The ice tray 71 is caught to the stoppers 57 while it is rotated about the support shafts 72*a* as viewed in the figure. Thus, since the ice tray 71 is distorted while it is rotated about the support shafts 72*a*, ice made in the ice-making grooves 71*s* can be separated from the ice tray.

In the illustrated embodiment, the stoppers 57 are configured to support a left end of the ice tray 71 as viewed in the figure. Therefore, the ice tray 71 is rotated about the support shafts 72*a* only in a clockwise direction as viewed in the figure. Hereinafter, for convenience of explanation, an end of the ice tray 71 which rotates upward in a state where the ice tray 71 is supported by the stoppers 57 is referred to as a front end of the ice tray 71. The other end of the ice tray 71 opposite to the tip end of the ice tray 71 is referred to as a rear end of the ice tray.

Although it has not been illustrated in the figures, the support shaft 72*a* is provided with an elastic member. The elastic member imparts an elastic force to the ice tray 71 in a direction opposite to a direction in which the ice tray 71 is rotated, i.e. in the clockwise direction as viewed in the figure. Therefore, if an elastic force for allowing the pivoting lever 73 to be pivoted is removed, the elastic force of the elastic member causes the ice tray 71 to be returned to an initial original position where the ice tray 71 is supported by the stoppers 57.

A sealing groove 72*b* is formed at the front end on a top surface of the ice tray 71. The sealing groove 72*b* is to seal up the ice-making grooves 71*s*. The sealing groove 72*b* is formed by downwardly depressing a portion of the front end on the top surface of the ice tray 71 by a predetermined depth. A sealing rib 77*a* of a tray cover 75 to be explained later is fitted into the sealing groove 72*b*.

A closely contacting rib 72*c* is provided at an edge of the front end on the top surface of the ice tray 71 adjacent to the sealing groove 72*b*. The rib 72*c* extends a predetermined length upward from the front end on the top surface of the ice tray 71. An inner surface of the rib 72*c* is brought into close contact with an outer surface of the sealing rib 77*a* fitted into the sealing groove 72*b*. In the illustrated embodiment, the closely contacting rib 72*c* is provided over the entire edge on the top surface of the ice tray 71 including the front end on the top surface of the ice tray 71.

The tray cover 75 is installed in the installation space 51*s* of the first ice-making housing 51. The tray cover 75 serves to selectively open or close the ice-making grooves 71*s* of the ice tray 71. The tray cover 75 is shaped into a plate corresponding to a cross section of the ice tray 71. Further, the tray cover 75 is preferably formed of a transparent or translucent material in order to allow a user to visually check a process of making ice in the ice-making grooves 71*s*.

The tray cover 75 is vertically pivoted in accordance with the pivot motion of the ice tray 71 in such a manner that one end of the tray cover (hereinafter, referred to as a 'front end') corresponding to the front end of the ice tray 71 is vertically moved with respect to the other end of the tray cover (hereinafter, referred to as a 'rear end') corresponding to the rear end of the ice tray 71. A supply port 75*h* is formed in the tray cover 75. The supply port 75*h* of the tray cover 75 functions as a passage through water stored in the water storage space 43*s* of the water tank 41 is supplied to the ice tray 71.

A water guide surface 75*a* is also formed on a top surface of the tray cover 75. The water guide surface 75*a* serves to guide water, which is guided by the guiding inclined portion 51*a* through the supply port 51*h* of the first ice-making housing 51, into the supply port 75*h* of the tray cover 75. The water guide surface 75*a* is formed into a conical shape by allowing a portion of the tray cover 75 to be inclined downward toward the supply port 75*h*.

A guide portion 75*b* is provided at an outer periphery of the water guide surface 75*a* on the top surface of the tray cover 75. The guide portion 75*b* serves to prevent water guided into the supply port 75*h* of the tray cover 75 by the water guide surface 75*a* from being splashed toward the installation space 51*s* of the first ice-making housing 51. Further, the guide portion 75*b* also serves to guide a portion of cold air, which is supplied into the installation space 51*s* of the first ice-making housing 51 through the handle opening 55 of the first ice-making housing 51, toward the ice tray 71 through the supply port 75*h* of the tray cover 75.

To this end, the guide portion 75*b* protrudes upward from the outer periphery of the water guide surface 75*a* on the top surface of the tray cover 75. At this time, the guide portion 75*b* is formed in such a manner that a height thereof decreases from a portion farthest away from the handle opening 55 to a portion closest to the handle opening 55. In other words, the guide portion 75*b* is formed in such a manner that a height thereof increases from a portion closest to the front end of the tray cover 75 to a portion closest to the rear end of the tray cover 75.

In the meantime, a shock absorbing member 76 is provided at the front end on the top surface of the tray cover 75. The shock absorbing member 76 serves to absorb shock generated when the tray cover 75 is rotated in cooperation of the pivot motion of the ice tray 71 and comes into contact with the guiding inclined portion 51*a*. Therefore, the shock absorbing member 76 is formed of an elastic material.

As shown in detail in FIG. 9, a pair of hinge brackets 78 are provided at the front end of the tray cover 75. The hinge brackets 78 extend respectively from both sides of the rear end of the tray cover 75 toward the inner rear sides of the first ice-making housing 51. The hinge hole 78*a* is formed in a tip end of each of the hinge brackets 78. The hinge pin 59 of the first ice-making housing 51 is inserted into the hinge hole 78*a* of the hinge bracket 78. Therefore, the tray cover 75 is vertically pivoted about the hinge pins 59 in accordance with the pivot motion of the ice tray 71. In the illustrated embodiment, the tray cover 75 is pivoted about the hinge pins 59 in a direction opposite to a direction in which the ice tray 71 is pivoted.

A cold air guide 79 is also provided between the pair of hinge brackets 78. The cold air guide 79 functions to guide a portion of cold air, which is supplied into the installation space 51*s* of the first ice-making housing 51 through the handle opening 55 of the first ice-making housing 51, toward the ice tray 71. The cold air guide 79 is installed in such a manner that both ends thereof are fixed to opposite surfaces of the hinge brackets 78, respectively. In practice, the tray cover 75, the hinge brackets 78 and the cold air guide 79 are integrally formed with one another. At this time, the cold air guide is preferably inclined downward toward the ice tray 71 to allow the cold air to be guided toward the ice tray 71.

The seating rib 77*a* is provided at the front end on a bottom surface of the tray cover 75. The sealing rib 77*a* extends a predetermined length downward from the front end on the bottom surface of the tray cover 75. A tip end of the sealing rib 77*a* is fitted into the seating groove 72*b* in a state where the ice-making grooves 71*s* of the ice tray 71 is covered by the tray cover 75. The outer surface of the sealing rib 77*a* is brought into close contact with the inner surface of the closely contact rib 72*c* in a state where the tip end of the sealing rib 77*a* is fitted into the sealing groove 72*b*.

A peripheral rib 77*b* is provided on the outer surface of the sealing rib 77*a*. The peripheral rib 77*b* extends perpendicular to the outer surface of the seating rib 77*a*. A bottom surface of the peripheral rib 77*b* is brought into close contact with a tip end of the closely contact rib 72*c* in a state where the tip end of the sealing rib 77*a* is fitted into the sealing groove 72*b* such that the rib 72*c* is brought into close contact with the rib 77*a*.

In the illustrated embodiment, the ice tray 71 and the tray cover 75 are sealed by means of the sealing groove 72*b*, the closely contact rib 72*c*, the sealing rib 77*a* and the peripheral rib 77*b*, but the present invention is not always limited thereto. For example, the ice tray 71 and the tray cover 75 may be sealed using a sealing means such as a gasket provided at an edge of the top or bottom surface of the ice tray 71 or the tray cover 75.

The second ice-making housing 61 is detachably installed onto the rear surface of the freezing chamber door 31*a* below the first ice-making housing 51. To this end, fixing grooves (not shown) into which the fixing protrusions of the support sidewalls 31*b* are fitted are formed on both external side surfaces of the second ice-making housing 61 in the same way as the first ice-making housing 51.

As shown in FIG. 10, the second ice-making housing 61 is formed into a polyhedral shape with a rear surface brought into close contact with the rear surface of the freezing chamber door 31*a* and partially opened top/bottom surfaces and side surfaces.

An open front lower portion of the second ice-making housing 61 communicates with an upper portion of the opening 35*c* in a state where the second ice-making housing 61 is mounted to the rear surface of the freezing chamber door 31*a*. The open top and bottom surfaces of the second ice-making housing 61 communicate with the open bottom surface of the first ice-making housing 51 and the open top surface of the home bar housing 35*a*, respectively.

Any one of the fixing protrusions of the support sidewalls 31*b* protrudes into the installation space 61*s* through a portion of the open side surface of the second ice-making housing 61. A cold air supply port 62 is provided on a front surface of the second ice-making housing 61. The cold air supply port 62 functions to deliver cold air in the freezing chamber 31 into the installation space 61*s* of the second ice-making housing 61.

In the meantime, the ice bank 81 is installed in the installation space 61*s* of the second ice-making housing 61. The ice bank 81 can be received in or withdrawn out of the installation space 61*s* of the second ice-making housing 61 through the opening 35*c*. For convenience of explanation, therefore, one surface of the ice bank 81 as viewed from the front surface of the freezing chamber door 31*a* is referred to as a front surface of the ice bank 81. This orientation also applies to other elements for receiving and withdrawing the ice bank 81, i.e. a guide box 83 and a guide frame 87 to be explained later.

The ice bank 81 is formed into a hexahedral shape with an open top. An ice storage space 81*s* in which ice made in the ice tray 71 is stored is defined within the ice bank 81. Further, at least one surface (preferably, the front surface) of the ice bank 81 is formed of a transparent or translucent material such that the ice stored in the ice storage space 81*s* can be visually checked from the outside.

A catching protrusion 81*a* is provided on a front lower end of the ice bank 81. Cooperating protrusions 81*b* are provided at rear upper ends on both side surfaces of the ice bank 81, respectively. The catching protrusion 81*a* protrudes downwardly from the front lower end of the ice bank 81 by a predetermined height and extends in a lateral direction. The cooperating protrusion 81*b* protrudes upward from the rear upper ends on the side surfaces of the ice bank 81 by a predetermined height.

The catching and cooperating protrusions 81*a* and 81*b* serve to allow the guide box 83 to be moved in cooperation with the ice bank 81 moving through the opening 35*c* in a direction in which the ice bank 81 is received in or withdrawn out of the installation space 61*s* of the second ice-making housing 61. To this end, the catching and cooperating protrusions 81*a* and 81*b* are selectively brought into close contact with a front end of a floor surface of the guide box 83 and rear ends of cooperating ribs 83*a* of the guide box 83, respectively.

Furthermore, a pair of movement preventing grooves 81*c* are formed on a bottom surface of the ice bank 81. Each of the movement preventing grooves 81*c* is formed by upward depressing a portion of the bottom surface of the ice bank 81 and extending in a front and rear direction. The grooves 81*c* are to prevent the ice bank 81 from being moved in a direction perpendicular to a moving direction of the ice bank in a state where the ice bank 81 is securely placed on the guide box 83.

An inclined portion 81*d* is provided at a rear lower end of the ice bank 81. The inclined portion 81*d* is formed in such a manner that the rear lower end of the ice bank 81 is inclined downward toward a direction in which the ice bank 81 is withdrawn out of the installation space 61*s* of the second ice-making housing 61 through the opening 35*c*. The inclined portion 81*d* is used for slightly upwardly inclining the ice bank 81, which has been withdrawn out of the installation space 61*s* of the second ice-making housing 61 through the opening 35*c*, to remove the ice bank 81 from the guide box 83 in a state where the ice bank is placed in the guide box 83.

The guide box 83 is installed within the installation space 61*s* of the second ice-making housing 61. The guide box 83 is formed into a hexahedral shape with the open top, front and back in correspondence with the ice bank 81. The ice bank 81 is securely placed in the guide box 83. The guide box 83 is guided by the guide frame 87 in a state where the ice bank 81 is securely placed therein, so that it can be received in or withdrawn out of the installation space 61*s* of the second ice-making housing 61 through the opening 35*c*.

In a state where the ice bank 81 is securely placed in the guide box 83, the front end of the floor surface of the guide box 83 is brought into close contact with a rear surface of the catching protrusion 81*a*. Therefore, if the ice bank 81 is moved in a direction in which it is received in the installation space 61*s* of the second ice-making housing 61, the catching rib 81*a* pushes the front end of the floor surface of the guide box 83 such that the guide box 83 can be received into the second ice-making housing 61 in cooperation with the ice bank 81.

The cooperating ribs 83*a* are provided at upper ends of both side surfaces of the guide box 83. Each of the cooperating rib 83*a* extends a predetermined length at the middle of the upper end of the side surfaces of the guide box 83 in an opposite direction. If the ice bank 81 is moved in a direction in which it is withdrawn out of the installation space 61*s* of the second ice-making housing 61 through the opening 35*c*, the cooperating protrusions 81*b* come into close contact with the rear ends of the cooperating ribs 83*a* to push the cooperating ribs 83*a* such that the guide box 83 can be withdrawn in cooperation with the ice bank 81.

As shown in FIG. 10, cooperating brackets 83*b* are provided on both sides of an open rear lower end of the guide box 83, respectively. The cooperating brackets 83*b* are provided on both sides of a rear end of a floor surface of the guide box 83 to come into close contact with the inclined portion 81*d* and both rear side ends of the ice bank 81. If the ice bank 81 is moved in a direction in which it is received into the installation space 61*s* of the second ice-making housing 61, therefore, the inclined portion 81*d* and both rear side ends of the ice bank 81 push the cooperating brackets 83*b* such that the guide box 83 can be received in the second ice-making housing in cooperation with the ice bank 81.

Further, referring to FIG. 11, a pair of movement preventing ribs 83*c* are provided on a floor surface of the guide box 83. Each of the movement preventing ribs 83*c* extends lengthwise in a front and rear direction on the floor surface of the guide box 83 and protrudes upward from the floor surface by a predetermined height. The ribs 83*c* are fitted into the grooves 81*c*, respectively, in a state where the ice bank 81 is securely placed on the guide box 83. Therefore, the ice bank 81 is not moved in a lateral direction, i.e. in a direction perpendicular to the moving direction of the ice bank, in a state where it is securely placed on the guide box 83.

Pairs of guide protrusions 84 and 85 are provided on both outer side surfaces of the guide box 83. The guide protrusions 84 and 85 are used to guide the guide box 83 that is received in or withdrawn out of the installation space 61*s* of the second ice-making housing 61 through the opening 35*c* in a state where the ice bank 81 is placed on the guide box 83. The guide protrusions 84 and 85 are slid along guide slots 88 and 89, respectively, in a state where the guide protrusions 84 and 85 are inserted in the guide slots 88 and 89.

In the illustrated embodiment, the guide protrusions 84 and 85 are called first and second guide protrusions 84 and 85, respectively. The first guide protrusions 84 protrude outward from upper central ends of both outer side surfaces of the guide box 83, respectively. The second guide protrusions 85 protrude outward from rear central ends of both outer side surfaces of the guide box 83, respectively. The first and second guide protrusions 84 and 85 are spaced apart from each other by a predetermined distance in a direction in which the ice bank 81 and the guide box 85 are received in or withdrawn out of the installation space 61*s* of the second ice-making housing 61 through the opening 35*c*. By doing so, the ice bank 81 and the guide box 83 can be maintained in a horizontal state while they are received in or withdrawn out of the installation space 61*s* of the second ice-making housing 61.

Furthermore, a guide frame 87 is provided to guide the inward or outward motion of the guide box 83 into or out of the second ice-making housing 61 in a state where the ice bank 81 is securely placed on the guide box 83. As shown in detail in FIG. 12, the guide frame 87 is formed into a hexahedral shape with the open front, rear and bottom. The guide box 83 is retractably installed forward into the guide frame 87.

An ice transfer opening 87*a* is formed in a top surface of the guide frame 87. The ice transfer opening 87*a* functions as a passage through which the ice made in the ice tray 71 is delivered into an ice storage space 81*s* of the ice bank 81. The ice transfer opening 87*a* is formed in such a manner that a portion of a top surface of the guide frame 87 is bored. It is preferred that the ice transfer opening 87*a* be formed into a rectangular shape having the size equal to or smaller than the open top of the ice bank 81, i.e. an inlet of the ice storage space 81*s*.

An ice transfer guide portion 87*b* is provided around the ice transfer opening 87*a* on the top surface of the guide frame 87. The ice transfer guide portion 87*b* is shaped into a hopper in such a manner that both sides thereof are inclined downward toward the ice transfer opening 87*a*. The ice transfer guide portion 87*b* serves to guide the supply of ice made in the ice tray 71 such that the ice can be supplied into the ice storage space 81*s* of the ice bank 81 through the ice transfer opening 87*a*.

The guide frame 87 is configured to guide downwardly inclined movement of the guide box 83 with the ice bank 81 securely placed thereon toward the open front of the guide frame 87, i.e. the opening 35*c*. This is to prevent introduction or withdrawal of the ice bank 81 from being hindered because ice stored in the ice storage space 81*s* of the ice bank 81 is caught to the rear surface of the freezing chamber door 31*a* adjacent to the opening 35*c*, when the ice bank 81 and the guide box 83 are received in or withdrawn out of the installation space 61*s* of the second ice-making housing 61 through the opening 35*c*.

In order to guide the downward movement of the ice bank 81 and the guide box 83 toward the opening 35*c* in this way, the pairs of guide slots 88 and 89 are provided on both side surfaces of the guide frame 87. The guide protrusions 84 and 85 are inserted in and slid along the guide slots 88 and 89, respectively. The guide slots 88 and 89 are called first guide slots 88 along which the first guide protrusions 84 are slid, and second guide slots 89 along which the second guide protrusions 85 are slid.

The guide box 83 with the ice bank 81 securely placed thereon are first moved in a horizontal state by a predetermined distance and then moved in a downwardly inclined state toward the opening 35*c*, when the first and second guide protrusions 84 and 85 are slid along the first and second guide slots 88 and 89, respectively. Then, the guide box 83 with the ice bank 81 placed thereon is moved in a horizontal state toward the opening 35*c* and is withdrawn out of the installation space 61*s* of the second ice-making housing 61 through the opening 35*c*.

Referring again to FIG. 11, each of the first guide slots 88 includes a first horizontal section 88*a*, an inclined section 88*b* and a second horizontal section 88*c*. The first horizontal section 88*a* extends a predetermined length horizontally from the center of an upper end of each side surface of the guide frame 87 in a withdrawal direction of the guide box 83, i.e. forward of the guide frame 87. The inclined section 88*b* extends a predetermined length from a front end of the first horizontal section 88*a* at a downwardly inclined angle in the withdrawal direction of the guide box 83. The second horizontal section 88*c* extends a predetermined length horizontally from a front end of the inclined section 88*b* in the withdrawal direction of the guide box 83. A front end of the second horizontal section 88*c* is positioned at a central portion of a front end of each side surface of the guide frame 87.

Each of the second guide slots 89 also includes a first horizontal section 89*a*, an inclined section 89*b* and a second horizontal section 89*c*. The first horizontal section 89*a* extends a predetermined length horizontally from the center of a rear end of each side surface of the guide frame 87 in a withdrawal direction of the guide box 83, i.e. forward of the guide frame 87. The inclined section 89*b* extends a predetermined length from a front end of the first horizontal section 89*a* at a downwardly inclined angle in the withdrawal direction of the guide box 83. The second horizontal section 89*c* extends a predetermined length horizontally from a front end of the inclined section 89*b* in the withdrawal direction of the guide box 83. A front end of the second horizontal section 89*c* is positioned at a lower portion of a front end of each side surface of the guide frame 87.

In a state where the guide box 83 is placed within the guide frame 87, i.e. the guide box 83 is received within the installation space 61*s* of the second ice-making housing 61, the first and second guide protrusions 84 and 85 are positioned at rear ends of the first horizontal sections 88*a* and 89*a* of the first and second guide slots 88 and 89, respectively. At this time, the top surfaces of the ice bank 81 and the guide box 83 are positioned adjacent to the ice transfer opening 87*a* of the guide frame 87 and to an upper end of the opening 35*c* in a state where the ice bank 81 and the guide box 83 are horizontally maintained.

In such a state, if the guide box 83 with the ice bank 81 securely placed therein is moved toward the opening 35*c*, the first and second guide protrusions 84 and 85 are slid along the inclined sections 88*b* and 89*b* of the first and second guide slots 88 and 89, respectively. Therefore, the guide box 83 is moved downward toward the opening 35*c* at a certain angle. At this time, the top surfaces of the ice bank 81 and guide box 83 are spaced apart by a predetermined distance downward from the ice transfer opening 87*a* of the guide frame 87 and from the upper end of the opening 35*c*.

Next, if the guide box 83 is further moved toward the opening 35*c*, the first and second guide protrusions 84 and 85 are slid along the second horizontal sections 88*c* and 89*c* of the first and second guide slots 88 and 89, respectively. Then, if the first and second guide protrusions 84 and 85 are positioned at front ends of the second horizontal sections 88*c* and 88*c* of the first and second guide slots 88 and 89, respectively, some portions of the ice bank 81 and the guide box 83 are withdrawn out of the installation space 61*s* of the second ice-making housing 61 through the opening 35*c*.

Fixing grooves 87*c* are formed on both outer side surfaces of the guide frame 87, respectively. The fixing grooves 87*c* are used to fix the guide frame 87. In the fixing grooves 87*c* are fitted the fixing protrusions which are formed on the support sidewalls 31*b* of the freezing chamber door 31*a* and protrude into the installation space 61*s* of the second ice-making housing 61 through the open portions of both side surfaces of the second ice-making housing 61.

In the illustrated embodiment, the ice bank 81 is guided by the guide frame 87 in a state where it is securely placed on the guide box 83. However, the present invention may be configured such that the ice bank 81 is guided directly by the guide frame 87 without using the guide box 83. In such a case, it is preferred that the guide protrusions be provided on both outer side surfaces of the ice bank 81 and the front ends of the guide slots 88 and 89 formed on the guide frame 81, i.e. the second horizontal sections 88*c* and 89*c* of the guide slots 88 and 89, be cut out up to the foremost ends of both side surfaces of the guide frame 81.

Hereinafter, a process of making ice and withdrawing the ice using an ice-making device for a refrigerator and a refrigerator having the same according to an embodiment of the present invention will be described in detail with reference to the accompanying drawings.

Figure 14:
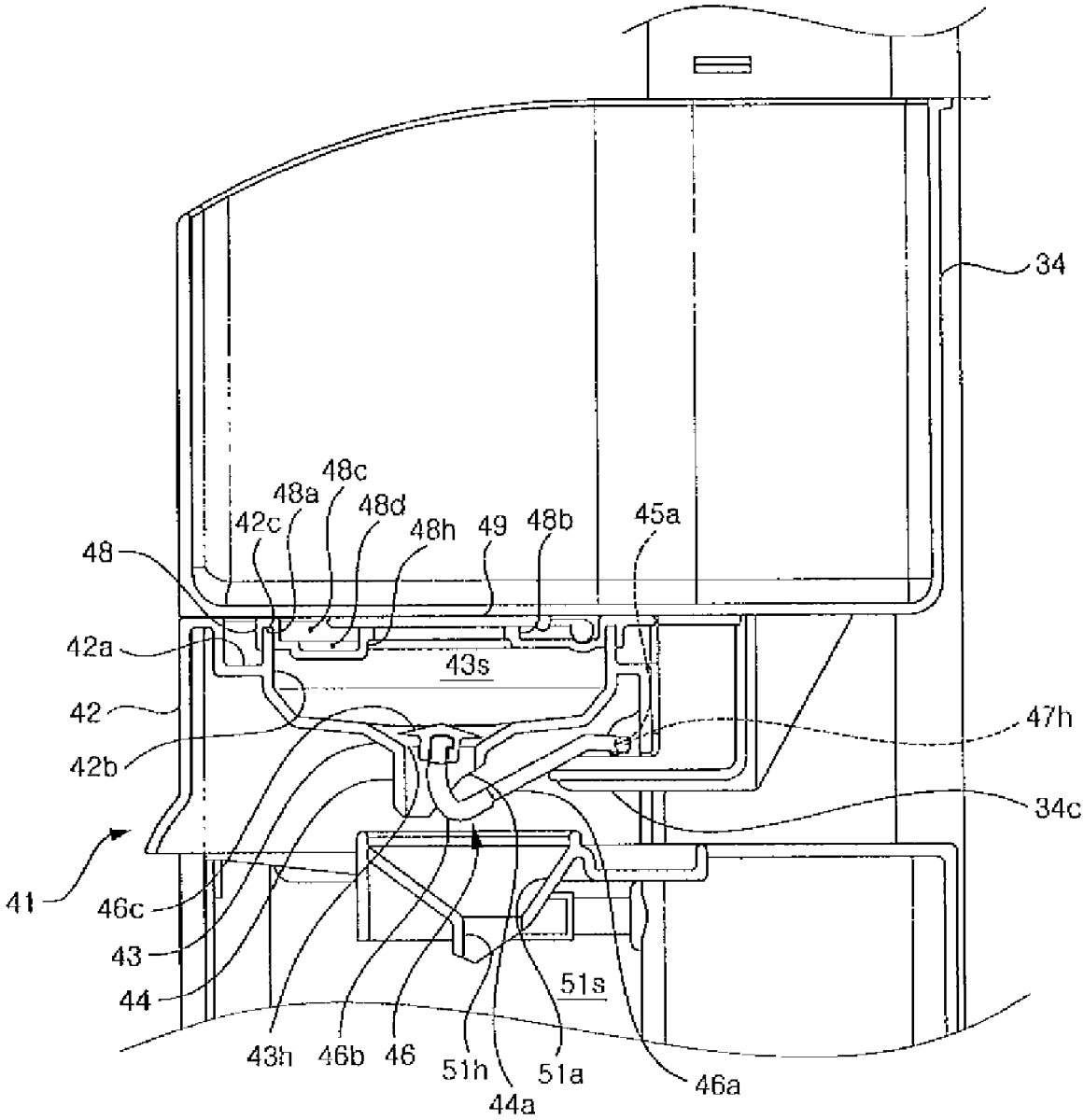
Figure 15:
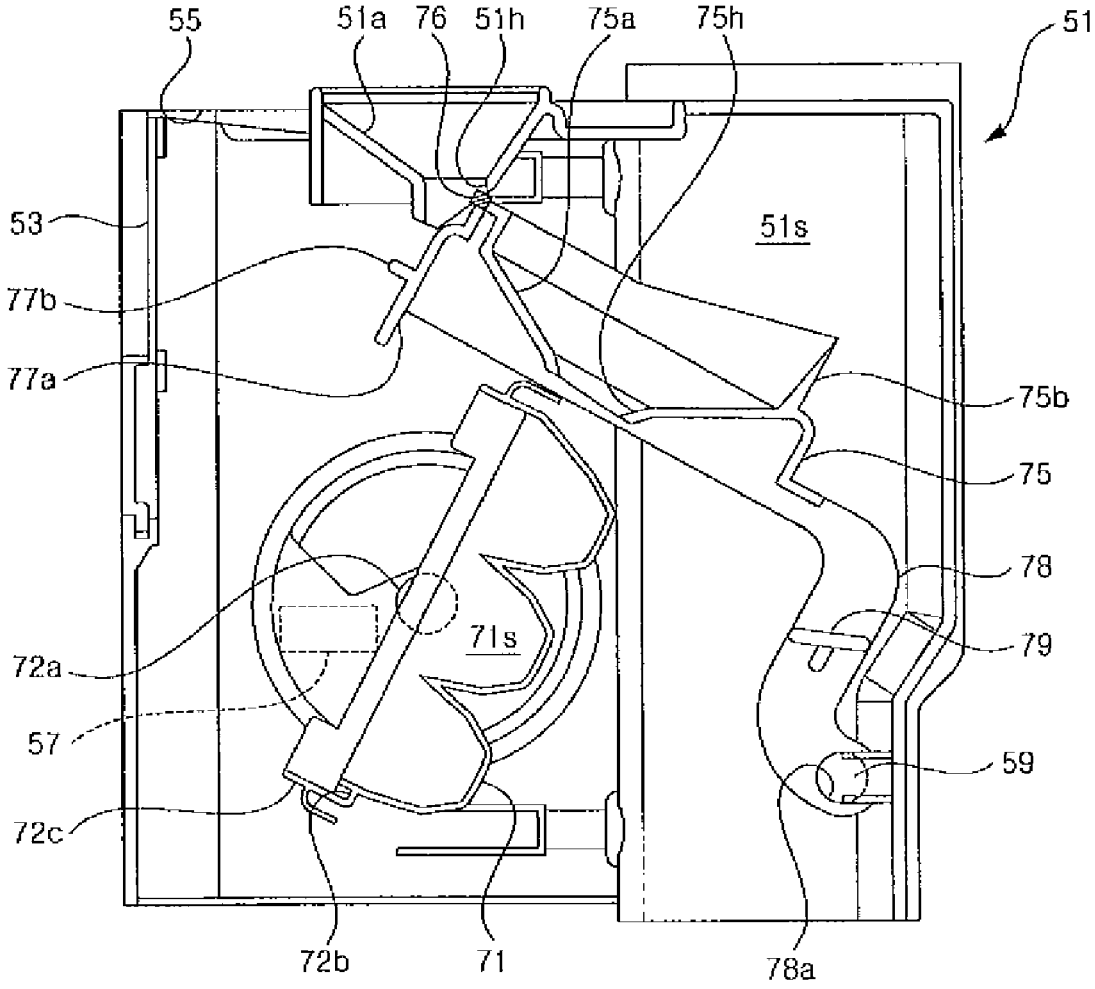
FIG. 15 is a side sectional view illustrating an operating process of an ice tray constituting the embodiment of the present invention shown in FIG. 5.
Figure 16:
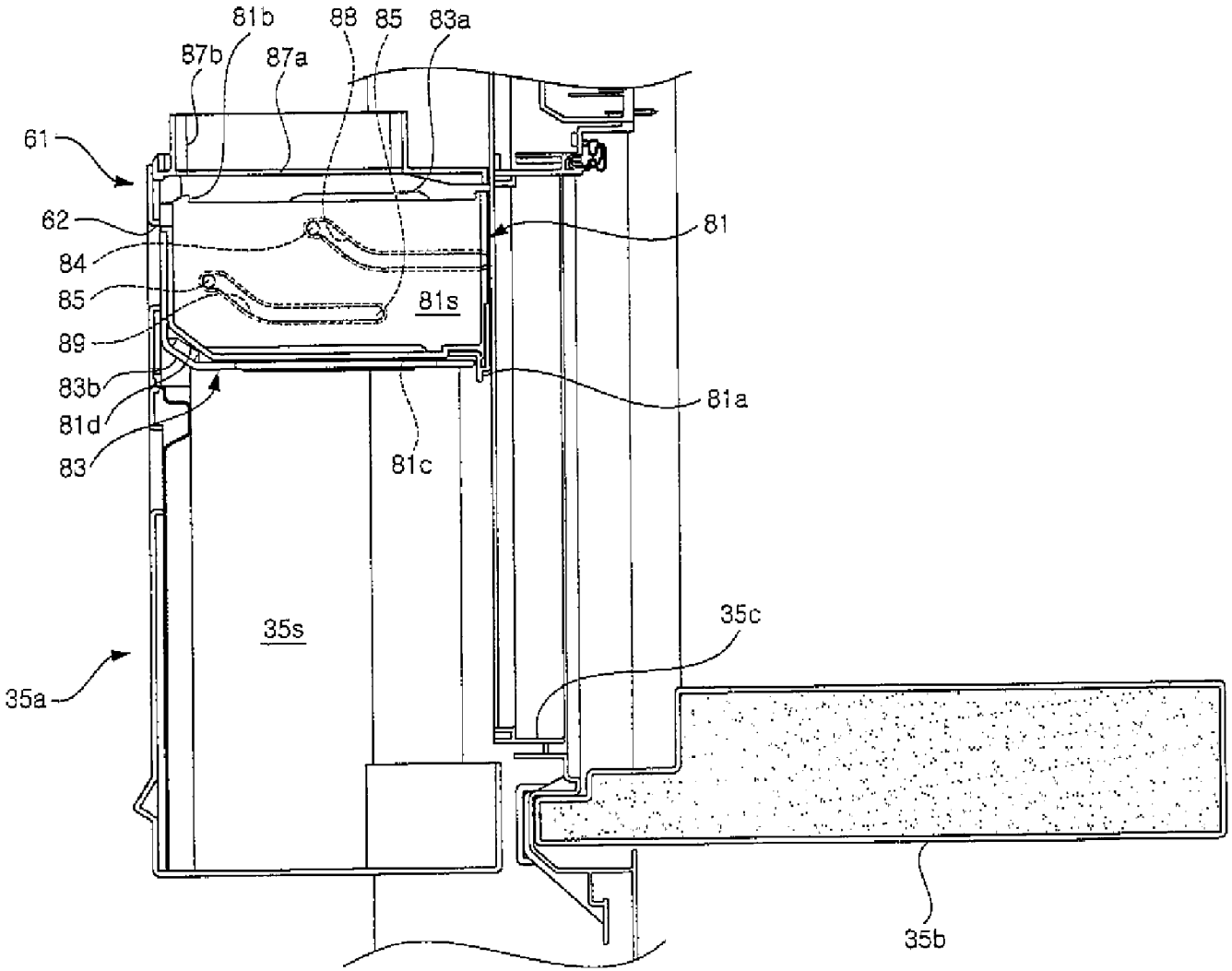
FIGS. 16 and 17 are side sectional views illustrating a withdrawing process of an ice bank constituting the embodiment of the present invention shown in FIG. 5.
Figure 17:
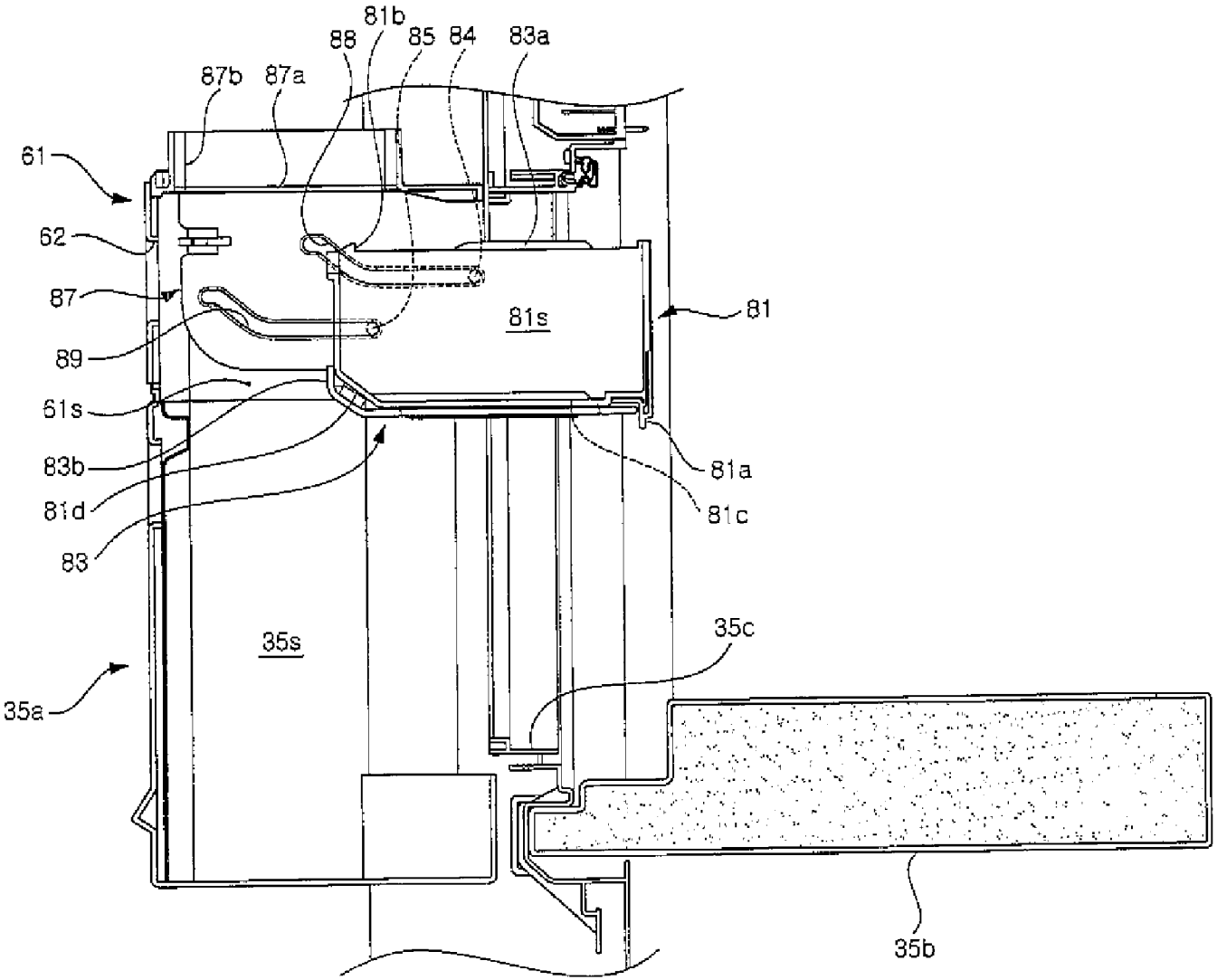

FIGS. 13 and 14 show a mounting process of the water tank of the ice-making device for a refrigerator according to the present invention; FIG. 15 shows an operating process of the ice tray of the ice-making device for a refrigerator according to the preferred embodiment of the present invention; and FIGS. 16 and 17 show a withdrawing process of the ice bank of the ice-making device for a refrigerator according to the preferred embodiment of the present invention.

As shown in FIG. 13, the water tank 41 of which the water storage space 43*s* is filled with a predetermined amount of water is first slid into the mounting space S. At this time, the discharge port 43*h* of the water tank 41 is in a state where it is closed by the valve cover 46*c*. Further, while the water tank 41 is mounted into the mounting space S, the top and bottom surfaces of the tank main body 42 come into close contact with the bottom surface of the door basket 34 and the top surface of the first ice-making housing 51, respectively. In addition, the guide ribs 53 of the first ice-making housing 51 are inserted in and slid along the guide grooves 42*d* of the tank main body 42. That is, the mounting of the water tank 41 is guided by the guide ribs 53 and the guide grooves 42*d*.

As shown in FIG. 14, if the water tank 41 is mounted into the mounting space S, the discharge port 43*h* of the water tank 41 is positioned in correspondence with the supply port 51*h* of the first ice-making housing 51. The fastening protrusions 42*e* are elastically fastened to the fastening hooks 34*a* of the door basket 34. Therefore, if the water tank 41 is mounted in the mounting space S, it is not inadvertently detached.

Further, if the water tank 41 is mounted in the mounting space S, the valve lever 46 is actuated by the actuating protrusion 34*c* and then pivoted upward. Further, the valve protrusion 46*b* of the valve lever 46 is also moved upward, i.e. into the water storage space 43*s* of the water tank 41. Therefore, the valve cover 46*c* for covering the discharge port 43*h* of the water tank 41 is also moved upward so that the discharge port 43*h* of the water tank 41 can be opened.

If the discharge port 43*h* of the water tank 41 is opened in such a way, water stored in the water storage space 43*s* of the water tank 41 drops onto the top surface of the tray cover through the supply port 51*h* of the first ice-making housing 51. At this time, the water stored in the water storage space 43*s* of the water tank 41 is guided into the supply port 51*h* of the first ice-making housing 51 by means of the guiding inclined portion 51*a* of the first ice-making housing 51.

Then, the water guided into the supply port 75*h* of the tray cover 75 is transferred into the ice-making grooves 71*s* of the ice tray 71. At this time, the water stored in the water storage space 43*s* of the water tank 41 substantially drops onto the water guide surface 75*a* of the tray cover 75. Therefore, the water stored in the water storage space 43*s* of the water tank 41 is guided by the water guide surface 75*a* of the tray cover 75 and then transferred into the ice-making grooves 71*s* of the ice tray 71 through the supply port 75*h* of the tray cover 75.

Further, a phenomenon that the water stored in the water storage space 43*s* of the water tank 41 drops onto the water guide surface 75*a* of the tray cover 75 and splashes into the installation space 51*s* of the first ice-making housing 51 can be prevented by mean of the guide portion 75*b*. Therefore, since the water stored in the water tank 41 does not splash into the installation space 51*s* of the first ice-making housing 51 while it is transferred to the ice-making grooves 71*s* of the ice tray 71, the space 51*s* of the first ice-making housing 51 can be prevented from being contaminated.

In the meantime, the water transferred into the ice-making grooves 71*s* of the ice tray 71 is frozen into ice due to cold air in the freezing chamber 31. At this time, the cold in the freezing chamber 31 is supplied into the installation space 51*s* of the first ice-making housing 51 through the handle opening 55 of the first ice-making housing 51. Further, the cold air supplied into the installation space 51*s* of the first ice-making housing 51 is guided into the ice tray 71 by means of the cold air guide 79 and the guide portion 75*b*.

Next, if the water contained in the ice-making grooves 71*s* of the ice tray 71 is frozen and formed into ice, the pivoting lever 73 is pivoted from a state shown in FIG. 8. As shown in FIG. 15, therefore, the ice tray 71 to which the pivoting lever 73 is connected is rotated about the support shafts 72*a* in a clockwise direction as viewed in this figure.

If the ice tray 71 rotates a predetermined angle, one side of the ice tray 71 is caught to the stoppers 57. Since the ice tray 71 is distorted if it is further rotated, the made ice is separated from the ice-making grooves 71*s*. The ice separated from the ice-making grooves 71*s* of the ice tray 71 is transferred to and stored in the ice storage space 81*s* of the ice bank 81. At this time, the ice stored in the ice bank 81 was guided by the ice transfer guide portion 87*b* of the guide frame 87 and transferred through the ice transfer opening 87*a* of the guide frame 87.

As shown in FIG. 16, in order to use the ice stored in the ice storage space 81*s* of the ice bank 81, an opening 35*c* is opened by opening the home bar door 35*b* of the home bar 35. Then, the ice bank 81 is pulled outward from the installation space 61*s* of the second ice-making housing 61, i.e. in a withdrawal direction.

At this time, as shown in FIG. 17, the guide box 83 with the ice bank 81 securely placed thereon is also moved in the withdrawal direction in cooperation with the ice bank 81. The movement of the ice bank 81 and the guide box 83 is guided by the guide protrusions 84 and 85 of the guide box 83 and the guide slots 88 and 89 of the guide frame 87.

That is, if the guide protrusions 84 and 85 are slid along the first horizontal sections 88*a* and 89*a*, the inclined sections 88*b* and 89*b*, and the second horizontal sections 88*c* and 89*c*, the guide box 83 is moved first horizontally and then at a downwardly inclined angle and finally again horizontally in the withdrawal direction. Therefore, even though too much ice is stored in the ice storage space 81*s* of the ice bank 81 and thus some ice protrudes upward from the ice bank 81, the ice bank 81 does not interfere with the freezing chamber door 31*a* when it is received in or withdrawn out of the second ice-making housing 61.

Further, if the guide protrusions 84 and 85 are positioned at the front ends of the second horizontal sections 88*c* and 89*c* of the guide slots 88 and 89, respectively, the guide box 83 cannot be further moved in the withdrawal direction. If the ice bank 81 is further pulled in the withdrawal direction in such a state, only the ice bank 81 can be moved in the withdrawal direction and then withdrawn out of the installation space 51*s* of the first ice-making housing 51.

At this time, the ice bank 81 is moved in the withdrawal direction until the cooperating protrusions 81*b* are brought into close contact with the rear ends of the cooperating ribs 83*a* of the guide box 83. Further, in a state where the cooperating protrusions 81*b* are brought into close contact with the rear ends of the cooperating ribs 83*a*, only the front end of the ice bank 81 is withdrawn out of the installation space 51*s* of the first ice-making housing 51.

In such a state, the ice bank 81 is moved upward at a certain angle toward the withdrawal direction. Therefore, the ice bank 81 is detached from the guide box 83 and are also completely withdrawn out of the installation space 51*s* of the first ice-making housing 51. At this time, the inclined portion 81*d* of the ice bank 81 prevents the ice bank 81 and the guide box 83 from interfering with each other while the ice bank 81 is detached from the guide box 83.

It will be apparent to those skilled in the art that various modifications and changes can be made thereto within the scope of the invention defined by the claims. Thus, the scope of the present invention should be construed on the basis of the claims.

INDUSTRIAL APPLICABILITY

From an ice-making device for a refrigerator and a refrigerator having the same according to the present invention so configured, the following effects can be expected.

First, according to the present invention, ice stored in an ice bank is taken out through a home bar. Therefore, since the ice bank can be received in or withdrawn out of a refrigerator without opening a refrigerator door, the ice can be more simply taken out.

Further, the ice bank is moved at a downwardly inclined angle and is withdrawn through the home bar. Therefore, it is possible to minimize a phenomenon that foods stored in the home bar are hindered from being received or withdrawn by the ice bank or the ice bank is hindered from being received or withdrawn by the ice stored in the ice bank.

In addition, since only a home bar door can be opened or closed to receive or withdraw the ice bank into or out of the refrigerator, leakage of cold air can be minimized while the ice is taken out. Therefore, power consumption of the refrigerator can be saved and thus the refrigerator can be utilized in a more economical way.

Furthermore, in a state where water required in making ice is stored in a water tank, the water is selectively supplied to an ice tray by means of an operation of a valve assembly when the water tank is installed or withdrawn. Therefore, since water necessary to make ice is supplied in a simpler way, ice can be made more easily.

Moreover, it is possible to prevent water necessary to make ice from being splashed onto the water tank or ice tray. Therefore, since it is possible to prevent a freezing chamber or a room from being contaminated due to the water, a refrigerator can be utilized more cleanly.

In addition, the ice tray is mounted into an installation space of an ice-making housing partitioned from the freezing chamber, and the ice tray is covered by a tray cover. Therefore, it is possible to prevent ice stored in the ice bank from being impregnated with odor of foods stored in a storage space of the refrigerator. As a result, a user can utilize ice in a more sanitary and comfortable way.

Finally, cold air supplied into the installation space of the ice-making housing can be more efficiently transferred to the ice tray. Therefore, a time taken to make ice in the ice tray is shortened to thereby allow a user to utilize the ice more rapidly.

The invention claimed is:

1. An ice-making device for a refrigerator, comprising:

a water tank detachably mounted to a rear surface of a refrigerator door;

an ice-making housing detachably mounted to the rear surface of the door below the water tank and provided with a predetermined installation space in the ice making housing;

an ice tray mounted into the installation space and formed with a plurality of ice-making grooves in which water supplied from the water tank is frozen into ice;

a valve assembly operating to selectively supply water stored in the water tank to the ice tray when the water tank is installed or withdrawn;

an ice bank for storing ice made in the ice tray, wherein the ice bank is installed in the installation space to be received in or withdrawn out of the installation space, wherein the valve assembly includes:

an actuating protrusion provided at a position on the rear surface of the door;

a valve lever actuated by the actuating protrusion and installed to be movable through a discharge port formed in a bottom surface of the water tank to supply the water stored in the water tank to the ice tray;

a valve cover provided at a tip end of the valve lever positioned in the water tank through the discharge port to selectively open or close the discharge port by movement of the valve lever; and an elastic member for imparting an elastic force to the valve lever in a direction in which the valve cover is moved to close the discharge port, and wherein the water tank is detachably installed in a mounting space defined between a bottom surface of a door basket provided on the rear surface of the door and a top surface of the ice-making housing; and the actuating protrusion is formed to extend a predetermined length on the bottom surface of the door basket or the top surface of the ice-making housing corresponding to the ceiling or bottom of the mounting space in a direction in which the water tank is received in or withdrawn out of the mounting space.

2. The ice-making device as claimed in claim 1, wherein the valve lever includes a lever main body installed below the water tank to allow a tip end of the lever main body to be pivotally moved vertically with respect to a pivot end of the lever main body by a predetermined angle, and a lever protrusion extending upward from the tip end of the lever main body to penetrate through the discharge port;

the valve cover is integrally formed with a tip end of the lever protrusion; and the valve lever is vertically pivoted within a range from a position where the valve cover is brought into close contact with a floor surface of the water tank adjacent to the discharge port to close the discharge port to a position where the valve cover is spaced apart from the floor surface of the water tank to open the discharge port.

3. The ice-making device as claimed in claim 2, wherein the elastic member is a torsion spring for imparting an elastic force to allow the valve lever to be pivoted downward.

4. The ice-making device as claimed in claim 1, wherein the water tank includes:

a tank main body formed into a polyhedral shape with an open top to define a water storage space in the tank main body and provided with a discharge port at a bottom surface of the tank main body;

a tank cover coupled to the open top of the tank main body to selectively open or close the water storage space and provided with a supply port at a predetermined position on the tank cover to allow water to be supplied and stored in the water storage space; and a supply port cover pivotally installed to the tank cover to selectively open or close the supply port, and the water tank is formed of a transparent or translucent material to visually check an amount of water stored in the water storage space from the outside.

5. The ice-making device as claimed in claim 1, wherein the water tank is prevented from being inadvertently detached, by a fixing means, in a state where the water tank is mounted to the rear surface of the door.

6. The ice-making device as claimed in claim 5, wherein the fixing means includes:

a fastening hook provided on any one of the rear surface of the door and a rear surface of the water tank; and a fastening protrusion provided on the other of the rear surface of the door or the rear surface of the water tank to be selectively and elastically fastened to the fastening hook.

7. The ice-making device as claimed in claim 6, wherein the fastening hook has predetermined elasticity and is provided on any one of the bottom surface of the door basket and the top surface of the ice-making housing corresponding to the ceiling or bottom of the mounting space.

8. The ice-making device as claimed in claim 1, wherein the water tank detachably installed to the rear surface of the door is guided by a guide means.

9. The ice-making device as claimed in claim 8, wherein the guide means includes:

a guide rib provided on any one of the rear surface of the door and a top surface of the water tank in a direction in which the water tank is received or withdrawn; and a guide groove provided on the other of the rear surface of the door and the top surface of the water tank such that the guide rib is inserted in and slid along the guide groove in the direction in which the water tank is received or withdrawn.

10. The ice-making device as claimed in claim 9, further comprising:

a pair of the guide ribs provided on the bottom surface of the door basket corresponding to the ceiling of the mounting space; and a pair of the guide grooves formed on the top surface of the water tank.

11. The ice-making device as claimed in claim 1, wherein the ice tray is installed in the installation space to be pivotal on a pair of support shafts provided on both sides of the ice tray and pivotally supported on inner sides of the ice-making housing.

12. The ice-making device as claimed in claim 11, further comprising a tray cover installed in the installation space to selectively open or close the ice-making grooves.

13. The ice-making device as claimed in claim 12, wherein the tray cover is installed to be pivotable about tip ends of hinge brackets in accordance with a pivot motion of the ice tray by means of the hinge brackets extending from both sides of an end of the tray cover to allow the tip ends of the hinge brackets to be pivotally connected to inner sides of the ice-making housing.

14. The ice-making device as claimed in claim 13, wherein the tray cover is provided with a sealing rib extending a predetermined length downward from a front end on a bottom surface of the tray cover, and a peripheral rib extending a predetermined length perpendicular to an outer surface of the sealing rib; and the ice tray is provided with a sealing groove formed by downwardly depressing an end of the ice tray corresponding to the front end of the tray cover by a predetermined depth to allow a tip end of the sealing rib to be fitted in the sealing groove, and a closely contact rib extending a predetermined length upward from a side of the ice tray adjacent to the sealing groove to allow an inner surface of the closely contact rib to be brought into close contact with an outer surface of the sealing rib and a tip end of the closely contact rib to be brought into close contact with a bottom surface of the peripheral rib.

15. The ice-making device as claimed in claim 12, wherein the tray cover further includes:

a supply port formed at a position of the tray cover to allow the water stored in the water tank to be transferred to the ice tray through said supply port;

a water guide surface formed at a top surface of the tray cover adjacent to the supply port to guide the water into the supply port; and a guide portion formed at a position on the top surface of the tray cover corresponding to an outer periphery of the water guide surface to guide cold air supplied into the installation space into the ice tray through the supply port as well as to prevent the water stored in the water tank from being splashed while the water is supplied into the ice-making grooves of the ice tray through the supply port.

16. The ice-making device as claimed in claim 15, wherein a height of the guide portion supply is increased in a direction in which the cold air is supplied into the installation space.

17. The ice-making device as claimed in claim 13, wherein a cold air guide is connected between facing surfaces of the hinge brackets at a predetermined inclined angle toward the ice tray to guide the cold air supplied into the installation space toward the ice tray.

18. The ice-making device as claimed in claim 13, wherein the front end of the tray cover is provided with a shock absorbing member for absorbing shock generated when one side of the tray cover pivoting in accordance with a pivot motion of the ice tray comes into contact with one side of the ice-making housing.

19. The ice-making device as claimed in claim 1, wherein the ice bank is received in or withdrawn out of the installation space through a home bar provided in the door.

20. The ice-making device as claimed in claim 19, wherein the home bar includes:

a home bar housing installed on the rear surface of the door below the ice-making housing and provided with a predetermined storage space;

an opening formed by cutting out a portion of the door to communicate with the storage space and the installation space; and a home bar door for selectively opening or closing the opening, and the ice bank is received in or withdrawn out of the installation space through the opening.

21. The ice-making device as claimed in claim 20, further comprising a guide frame installed within the installation space to guide the ice bank at a downwardly inclined angle toward the opening.

22. The ice-making device as claimed in claim 21, further comprising a guide box guided by the guide frame and received in or withdrawn out of the installation space through the opening in a state where the ice bank is securely placed on the guide box.

23. The ice-making device as claimed in claim 22, wherein a pair of guide protrusions and a pair of guide slots are provided on both outer side surfaces of the guide box and both corresponding inner side surfaces of the guide frame, respectively, whereby the guide protrusions are inserted in and slid along the guide slots when the ice bank is moved in a direction in which the ice bank is received in or withdrawn out of the installation space.

24. The ice-making device as claimed in claim 23, wherein the guide protrusions are spaced apart from each other by a predetermined distance in a direction in which the ice bank is received in or withdrawn out of the installation space; and both ends of the guide slots are spaced apart from each other by a predetermined distance corresponding to the spaced distance of the guide protrusions.

25. The ice-making device as claimed in claim 24, wherein each of the guide slots includes a first horizontal section extending a predetermined length horizontally from a position on each side surface of the guide frame in a direction in which the ice bank is withdrawn out of the installation space, an inclined section extending a predetermined length from a front end of the first horizontal section a downwardly inclined angle in the withdrawal direction of the ice bank, and a second horizontal section extending a predetermined length horizontally from a front end of the inclined section in the withdrawal direction of the ice tray.

26. The ice-making device as claimed in claim 22, wherein the ice bank is formed into a hexahedral shape with an open top and provided with an ice storage space in the ice bank, and the guide box is formed into a hexahedral shape with open top, front and back in correspondence with the ice bank.

27. The ice-making device as claimed in claim 23, wherein cooperating protrusions and cooperating ribs are provided at rear ends of both the side surfaces of the ice bank and upper ends of both the side surfaces of the guide box, respectively, whereby the cooperating protrusions come into close contact with rear ends of the cooperating ribs and push the cooperating ribs to thereby allow the guide box to move together with the ice bank when the ice bank is moved in the withdrawal direction of the ice bank.

28. The ice-making device as claimed in claim 27, wherein a catching rib is provided at a front lower end of the ice bank;

cooperating brackets are provided at lower ends of both sides on an open rear surface of the guide box, respectively; and the catching rib comes into close contact with a front end of a floor surface of the guide box to push the front end of the guide box and both sides of a rear lower end of the ice bank come into close contact with the cooperating brackets, respectively, to push the cooperating brackets when the ice bank is moved in a direction in which the ice bank is received in the installation space, whereby the guide box is moved together with the ice bank.

29. The ice-making device as claimed in claim 28, wherein at least one movement preventing groove is formed on any one of a bottom surface of the ice bank and the corresponding floor surface of the guide box in a direction in which the ice bank and the guide box are moved; and at least one movement preventing rib is formed on the other of the bottom surface of the ice bank and the floor surface of the guide box in the moving direction of the ice bank and the guide box, whereby the movement preventing rib is inserted in the movement preventing groove.

30. The ice-making device as claimed in claim 29, wherein an inclined portion is formed at the rear lower end of the ice bank at a downwardly inclined angle in the withdrawal direction of the ice bank to allow the ice bank, which is withdrawn out of the installation space through the opening in a state where the ice bank is securely placed on the guide box, to be moved at an upwardly inclined angle and thus the ice bank to be detached from the guide box.

* * * * *